US011821297B2

(12) United States Patent
Haustveit et al.

(10) Patent No.: US 11,821,297 B2
(45) **Date of Patent: *Nov. 21, 2023**

(54) SYSTEMS AND METHODS FOR CONTROLLING FRACTURING OPERATIONS USING MONITOR WELL PRESSURE

(71) Applicant: Devon Energy Corporation, Oklahoma City, OK (US)

(72) Inventors: Kyle L. Haustveit, Edmond, OK (US); Tarik Ouradi, Edmond, OK (US); Brendan M. Elliott, Oklahoma City, OK (US); Jacob R. Melton, Oklahoma City, OK (US); Toby T. Deen, Edmond, OK (US); John T. Dwyer, Oklahoma City, OK (US)

(73) Assignee: Devon Energy Corporation, Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/808,065

(22) Filed: Jun. 21, 2022

(65) Prior Publication Data

US 2022/0403724 A1 Dec. 22, 2022

Related U.S. Application Data

(63) Continuation of application No. 15/879,187, filed on Jan. 24, 2018, now Pat. No. 11,365,617.

(Continued)

(51) Int. Cl.

| | |
|---|---|
| ***E21B 43/26*** | (2006.01) |
| ***E21B 43/267*** | (2006.01) |
| ***E21B 47/06*** | (2012.01) |

(52) U.S. Cl.

CPC ..... *E21B 43/267* (2013.01); *E21B 47/06* (2013.01)

(58) Field of Classification Search

CPC ..... E21B 43/267; E21B 47/06

See application file for complete search history.

(56) References Cited

U.S. PATENT DOCUMENTS 5,065,821 A * 11/1991 Huang ..... E21B 43/305 166/402

2011/0120718 A1* 5/2011 Craig ..... E21B 43/16 166/305.1

(Continued)

*Primary Examiner* — Christopher J Sebesta

(74) *Attorney, Agent, or Firm* — Polsinelli PC; Gregory P. Durbin

(57) ABSTRACT

Systems and methods for controlling fracturing operations include monitoring pressure within a monitor well poroelastically couplable to an active well. In response to pressure changes observed in the monitor well, operational parameters of the fracturing operation are modified to, among other things, encourage or inhibit fracture initiation and propagation. For example, modifications to properties of the fracturing fluid, modification to pumping parameters, rate cycling, and diversion operations may each be undertaken in response to observed pressure changes within the monitor well. Single-well applications are also provided in which pressure measurements are obtained from an isolated section of a well poroelastically couplable to an uphole section of the same well. The pressure measurements are subsequently used to control fracturing operations of the uphole section.

20 Claims, 15 Drawing Sheets

Related U.S. Application Data

(60) Provisional application No. 62/449,905, filed on Jan. 24, 2017.

(56) References Cited

U.S. PATENT DOCUMENTS

| | | | | |
|---|---|---|---|---|
| 2013/0277050 | A1* | 10/2013 | Cherian | E21B 47/06 166/52 |
| 2015/0075778 | A1* | 3/2015 | Walters | E21B 47/06 166/250.1 |
| 2015/0083405 | A1* | 3/2015 | Dobroskok | E21B 47/002 166/250.1 |
| 2017/0002652 | A1* | 1/2017 | Kampfer | E21B 49/008 |

* cited by examiner

1000

| Stage (1002) | Trigger (1004) | Action (1006) | Test (1008) | If Successful (1010) | If Not Successful |
|---|---|---|---|---|---|
| … | … | … | … | … | … |
| 47 | +5 psi on first ramp | Rate cycle to 0 bpm for 3 minutes | Rate of pressure change decrease by >20% | Continue base schedule | After 5 min., repeat rate cycle and start linear gel |
| 48 | +20 psi on first ramp | Rate cycle to 0 bpm for 3 minutes | Rate of pressure change decrease by >20% | Continue base schedule | After 5 min., repeat rate cycle and start linear gel |
| … | … | … | … | … | … |

FIG. 10

SYSTEMS AND METHODS FOR CONTROLLING FRACTURING OPERATIONS USING MONITOR WELL PRESSURE

CROSS-REFERENCE TO RELATED APPLICATIONS

This continuation application is related to and claims priority to U.S. Nonprovisional patent application Ser. No. 15/879,187 filed Jan. 24, 2018 entitled "SYSTEMS AND METHODS FOR CONTROLLING FRACTURING OPERATIONS USING MONITOR WELL PRESSURE," which claims priority under 35 U.S.C. § 119(e) from U.S. Patent Application No. 62/449,905 filed Jan. 24, 2017 entitled "SYSTEMS AND METHODS FOR CONTROLLING FRACTURING OPERATIONS USING MONITOR WELL PRESSURE," all of which are hereby incorporated by reference in their entirety for all purposes.

TECHNICAL FIELD

Aspects of the present disclosure involve completion of wellbores for production of hydrocarbons from subterranean formations and, more particularly, fracturing of subterranean formations through which such wellbores extend.

BACKGROUND

Hydraulic fracturing is a technique for improving yields (greater volume over a longer period of time) of oil and/or gas production from unconventional reservoirs, including shales, typically characterized by tight or ultra-tight subterranean formations where the oil or gas in the formation does not flow in commercially viable volumes through conventionally drilled wellbores. In many cases, fracturing is performed in a horizontal section of a wellbore where a vertical section extends from the surface to a target area (pay zone) of the formation, such as shale strata some distance from the surface, and the horizontal section of the wellbore extends from the vertical section and is drilled through the target area. For example, it may be known that shale may be found between 6000 and 7000 feet below the surface of an area, and in some specific formation. In such cases, a vertical section of a well may be drilled to 6500 feet below the surface and the horizontal section of the well may then drilled outward for several thousand feet from the vertical section within the strata at approximately 6500 feet depth.

Once drilled, a well is generally completed by running and fixing casing within the wellbore (e.g., by cementing), perforating the casing where fracturing is targeted, and applying a well stimulation technique, such as hydraulic fracturing, to the surrounding formation. In open hole wells, the step of running and fixing casing within the well is omitted. Fracturing, generally speaking, involves pumping of fluid from the surface at high volume and pressure into the wellbore and into the formation surrounding the wellbore. The resource bearing formation surrounding the wellbore fractures under the pressure and volume of the injected fluid, increasing the size and quantity of pathways for hydrocarbons trapped within the formation to flow from the formation into the wellbore. The hydrocarbons may then be recovered at the surface of the well.

It is with these observations in mind, among others, that aspects of the present disclosure were conceived.

SUMMARY

In a first implementation of the present disclosure, a method of fracturing a subterranean formation is provided.

The method includes obtaining a first rate of pressure change from a first well extending through the subterranean formation. A fracturing fluid is pumped at a first rate into a second well extending through the subterranean formation and poroelastically couplable to the first well. A second rate of pressure change within the first well is obtained during the pumping and a difference between the first and second rates of pressure change is identified. Based on the difference between the rates of pressure change, the fracturing fluid is pumped into the second well at a second rate different from the first rate.

In another implementation of the present disclosure, a method of controlling fracturing of a subterranean formation using a computing system is provided. The method includes receiving, at the computing system, first pressure data corresponding to a first well extending through the subterranean formation. Based on the first pressure data, the computing system calculates a first rate of pressure change. The computing system then receives second pressure data corresponding to the first well during pumping of a fracturing fluid at a first rate into a second well extending through the subterranean formation and poroelastically couplable to the first well. The computing system then calculates a second rate of pressure change based on the second pressure data and identifies a difference between the second rate of pressure change and the first rate of pressure change. The computing system then determines a second pumping rate, different from the first rate, based on the difference between the rates of pressure change.

In yet another implementation of the present disclosure, one or more non-transitory tangible computer-readable storage media is provided. The computer-readable storage media stores computer-executable instructions for performing a computer process on a computer system. The computer process includes receiving first pressure data corresponding to a first well extending through the subterranean formation and calculating a first rate of pressure change based on the first pressure data. Process further includes receiving second pressure data corresponding to the first well during pumping of a fracturing fluid at a first rate into a second well extending through the subterranean formation and poroelastically couplable to the first well. A second rate of pressure change based on the second pressure data is then calculated and a difference between the second rate of pressure change and the first rate of pressure change is identified. The process further includes determining a second pumping rate, different from the first rate, based on the difference between the rates of pressure change.

In still another implementation of the present disclosure, a pump system for providing fracturing fluid to a subterranean formation is provided. The pump system includes a pump couplable to a wellhead of an active well and configured to provide fluid into the active well at each of a first and second flow rate, the second flow rate being different than the first flow rate. The pump system further includes a computing device communicatively coupled to the pump and configured to transition the pump between the first and second flow rates in response to receiving a first control signal. The first control signal is determined by comparing first and second rates of pressure change within a monitor well poroelastically couplable to the active well where the second rate of pressure change corresponds to a rate of pressure change of the monitor well when the pump provides fluid to the active well at the first flow rate.

In another implementation of the present disclosure, a method of obtaining a hydrocarbon is provided. The method includes receiving a hydrocarbon produced from an active well extending through a subterranean formation and previously fractured by a rate cycling process. The rate cycling process used to fracture the active well further includes obtaining a first rate of pressure change measurement from a monitor well extending through the subterranean formation and poroelastically couplable to the active well. The process further includes pumping a fracturing fluid into the active well at a first rate and obtaining a second rate of pressure change measurement from the monitor well during pumping of the fracturing fluid into the active well. A difference between the first rate of pressure change measurement and the second rate of pressure change measurement is then identified and the fracturing fluid is pumped into the active well at a second rate, different from the first rate, based on the difference between the first rate of pressure change measurement and the second rate of pressure change measurement.

In yet another implementation of the present disclosure, a method of fracturing a subterranean formation is provided. The method includes obtaining a first pressure measurement from a first well extending through the subterranean formation. The method further includes pumping a fracturing fluid having a fracturing fluid parameter having a first value into a second well extending through the subterranean formation. A second pressure measurement is obtained during pumping of the fracturing fluid into the second well and a difference between the first pressure measurement and the second pressure measurement is identified. Based on the difference, the fracturing fluid is pumped into the second well such that the fracturing fluid parameter has a second parameter value different from the first parameter value.

In another implementation of the present disclosure, a method of fracturing a subterranean formation is provided. The method includes obtaining at least one first pressure measurement from a first well extending through the subterranean formation and pumping a fracturing fluid into a second well extending through the subterranean formation. The method further includes obtaining at least one second pressure measurement from the first well during pumping of the fracturing fluid into the second well and identifying a difference between the first pressure measurement and the second pressure measurement where the difference is induced, at least in part, by a fluid coupling of the first well and the second well. The method also includes pumping the fracturing fluid into the second well at a second rate, different from the first rate, based on the difference between the first and second pressure measurements.

In yet another implementation of the present disclosure, a method of fracturing a subterranean formation is provided. The method includes obtaining at least one first pressure measurement from a first well section extending through the subterranean formation. A fracturing fluid is pumped into a second well section extending through the subterranean formation and poroelastically couplable with the first well section according to a first set of fracturing operation parameters. During pumping of the fracturing fluid into the second well section, at least one second pressure measurement is obtained from the first well section. A difference between the first pressure measurement and the second pressure measurement is identified and the fracturing fluid is pumped into the second well section according to a second set of fracturing operation parameters, the second set of fracturing operation parameters being different than the first set of fracturing operation parameters and based on the different between the pressure measurements.

BRIEF DESCRIPTION OF THE DRAWINGS

The foregoing and other objects, features, and advantages of the present disclosure set forth herein will be apparent from the following description of particular embodiments of those inventive concepts, as illustrated in the accompanying drawings. It should be noted that the drawings are not necessarily to scale; however the emphasis instead is being placed on illustrating the principles of the inventive concepts. Also, in the drawings the like reference characters may refer to the same parts or similar throughout the different views. It is intended that the embodiments and figures disclosed herein are to be considered illustrative rather than limiting.

FIG. 10 is a table illustrating example stages of a well completion.

DETAILED DESCRIPTION

Figure 1:
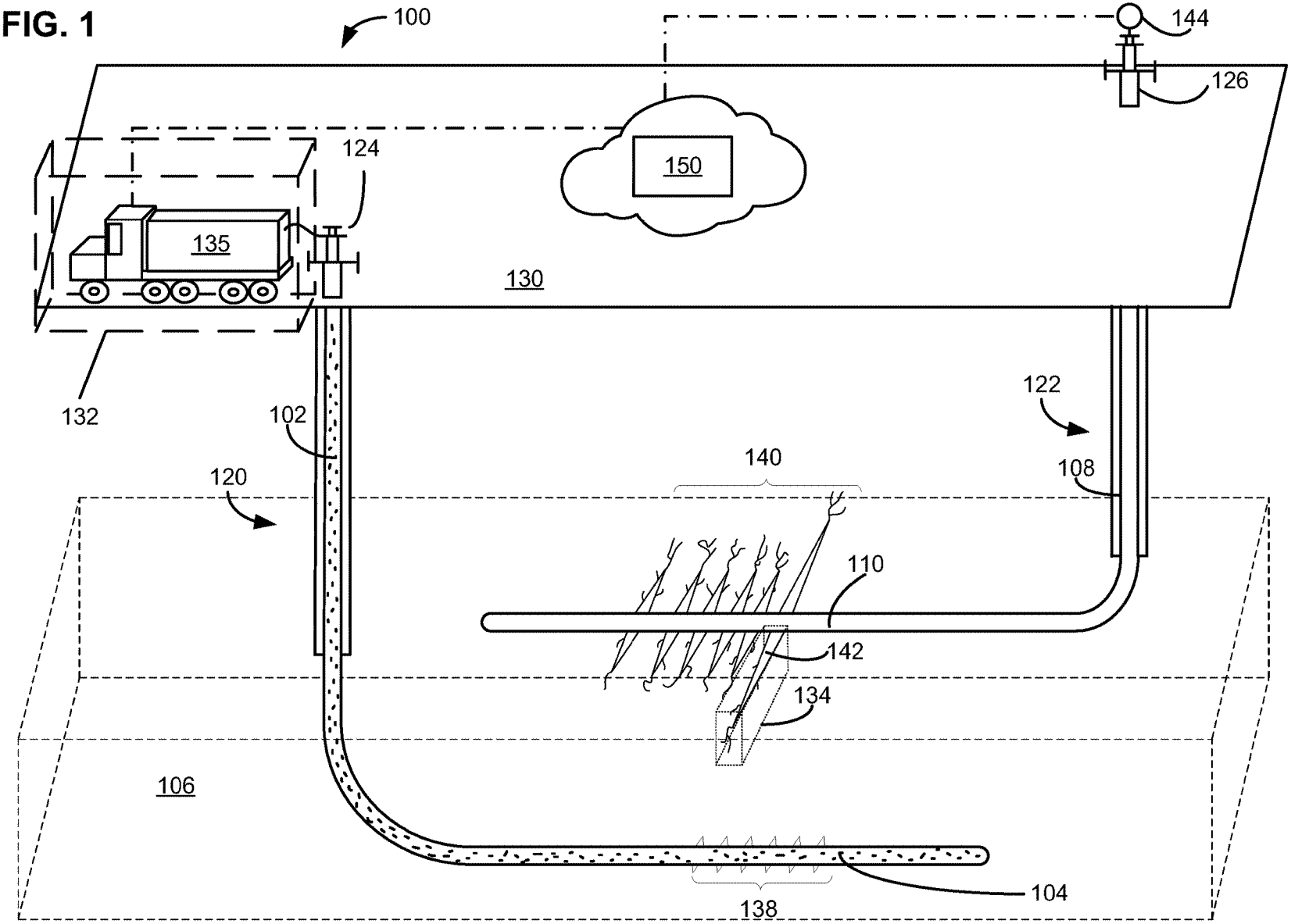
FIG. 1 is a schematic diagram of an example well completion environment for completing a fracturing operation in accordance with the present disclosure.

Aspects of the presently disclosed technology involve controlling one or more aspects of a fracturing operation, alone or in combination. In certain implementations, the presently disclosed technology involves rate cycling of fracturing fluid injected into a wellbore during the fracturing operation based on measurements made at a monitor well. Rate cycling is a technique in which the rate at which fracturing fluid is pumped into a well is varied throughout the fracturing operation. The cycles are controlled based on feedback from the monitor well. Generally, the flow rate may be cycled between a relatively higher flow rate to promote development and propagation of fractures within the formation and a relatively lower flow rate to release stresses induced in the formation during the high flow rate period, although many other cycles and bases for such cycles are possible.

It is understood that rate cycling of fracturing fluid during a fracturing operation may provide several benefits, alone or in combination. First, rate cycling may inhibit focused growth of only a limited number of dominant fractures in an area of the wellbore being completed. Stated differently, controlled rate cycling may distribute the fracturing fluid across many fractures and grow such fractures rather than focusing the fluid to relatively fewer numbers of dominant fractures in any given stage being fractured. Second, rate cycling may initiate new fractures within the stage being completed. Thus, in a simplified example, rather than growing the dominant fracture group, several new fractures may be successively initiated and grown after a rate cycle or rate cycles. Third, rate cycling may be controlled and used to prohibit breakthrough of fractures from a wellbore being completed into an adjacent wellbore. Fourth, rate cycling may facilitate fracturing operations without the need for diverters in the fracturing fluid. In effect, it is believed that rate cycling has the effect of diverting an increased proportion of fracturing fluid from dominant fractures undergoing significant propagation prior to the rate cycle into new, or smaller fractures, after the rate cycle. Fifth, rate cycling may facilitate a greater production volume and a greater production longevity of a fractured wellbore and possibly reduce initial completion costs. For example, it is believed that a greater number of fractures may be initiated resulting in greater production from the wellbore at less relative cost than the same wellbore fractured without the controlled rate cycling techniques described herein. Moreover, the same wellbore may be completed without particulate diverters thus providing additional cost advantages and/or production advantages relative to conventional techniques using particulate diverters.

Propagation and distribution of fractures may also be controlled by varying other parameters of a fracturing operation. Such parameters may include, without limitation, fracturing fluid viscosity, proppant size, proppant concentration, fracturing fluid additive ratios, and fracturing fluid injection rate. To further promote or inhibit fracture growth and distribution, one or more of such parameters may be modified during the course of a fracturing operation in response to measurements obtained from a monitor well and. For example, if increased fracture propagation is desired, fracturing fluid viscosity may be increased. Conversely, if further fracture growth is to be inhibited, viscosity may be reduced.

The success of a fracturing operation generally depends on adequate distribution and propagation of fractures within the area of the formation around a wellbore being fractured. However, due to the remoteness of the fractures being formed it is often difficult or cost-prohibitive to accurately determine how a given fracturing operation is progressing.

To control fracturing operations (e.g., by modifying fracturing operation parameters such as injection rate, viscosity, proppant size, proppant concentration, etc.) during fracturing of a wellbore being completed (referred to herein as an active well), systems and methods according to certain implementations of the present disclosure monitor pressure in an adjacent well, referred to herein as a monitor well. A portion of the monitor well is poroelastically couplable to the active well such that a pressure response is produced in the monitor well during fracturing of the active well. For example, the monitor well may include a section spaced within 1000 to 2000 feet from the stage of the active well being completed and include at least one fracture, referred to herein as a monitor or transducer fracture, that extends from the monitor well toward the stage of the active well undergoing completion. Stated simply, as fluid is pumped into the active well and fractures are formed and/or propagate through the formation, the transducer fracture is compressed, thereby increasing pressure within the monitor well. More specifically, according to the principles of poroelasticity, fractures propagating from the active wellbore during fracturing induce pressure changes in the monitor well when the fractures from the active well overlap the transducer fracture of the monitor well. When this occurs, pressure in the monitor well increases relative to some baseline pressure or rate of pressure change, such as a leak off rate. Such pressure changes may be observed, for example, as an increase in pressure relative to a baseline pressure of the monitor well or a decrease in the leak off rate of the monitor well as compared to a baseline leak off rate of the monitor well obtained prior to initiating the fracturing operation in the active well.

In certain implementations, characteristics of one or more of the monitor well, the active well, and the transducer fracture are used, at least in part, to characterize the pressure response of the monitor well as well as use the information to further define completion operations. For example, the geometry of the monitor well and/or the transducer fracture may be used in analyzing the pressure response caused by injecting fracturing fluid into the active well. A calibration operation may also be performed to determine characteristics of one or more of the active well, the monitor well, and the subterranean formation between the active well and the monitor well. For example, in one embodiment, a fracture formation rate of the subterranean formation may be determined. To do so, a single entry point may be made in the active well and fracturing fluid may be pumped into the active well at a known rate. When a corresponding pressure response in the monitor well is observed, the single fracture has extended from the active well to overlap the monitor well and/or a fracture of the monitor well. Accordingly, by knowing the distance between the active well and the monitor well/monitor well fracture and the rate at which fracturing fluid was provided to the active well, an approximate relationship between flow rate of fracturing fluid and fracture growth can be determined. For example, if 100 barrels of fracturing fluid cause a pressure response in a monitor well 1000 feet away from the active well, every barrel of fracturing fluid creates approximately 10 feet of fracture half-length.

Changes in the pressure within the monitor well can then be used to approximate, without limitation, the location, size, direction, and similar characteristics of fractures associated with the active well and to dynamically control or inform the fracturing operation. For example, the fracturing operation may be controlled in response to changes in pressure observed within the monitor well by, without limitation, one or more of changing the flow rate of fracturing fluid provided to the active well, changing the duration for which a particular flow rate is maintained, changing the pressure of fracturing fluid provided to the active well, changing the concentration of proppants and/or density of the fracturing fluid, and controlling whether to continue or cease fracturing operations in whole or in part. Such controls may be done alone or in various possible combinations. Accordingly, pressure within the monitor well may be used to dynamically adjust parameters of the fracturing operation in response to characteristics of the subterranean formation through which the fractures extend, characteristics of the fractures, characteristics of initial perforations in the wellbore, and other sources of variability in the fracturing operation.

In certain implementations, control of fracturing operations may be achieved, at least in part, by a computing system adapted to receive and process data collected from the monitor well. The computing system may be communicatively coupled to equipment for performing a fracturing operation such that the computing system may modify one or more operational parameters of the equipment in response to the received data. The logic and outputs governing control by the computing system may be maintained in a fracturing operation plan executable by the computing system. Control of the equipment may also be accomplished, in whole or in part, through manual intervention by an operator. For example, the computing system may receive data and generate an updated fracturing operation plan that may then be manually executed by an operator who activates, deactivates, or otherwise modifies operational parameters of equipment for performing the fracturing operation.

The monitor well is generally capped under pressure and pressure within the monitor well is measured using, for example, gauges or transducers located at the well head. Alternatively, downhole transducers may be installed within the monitor well and communicatively coupled to communication devices disposed at the well head. In certain implementations, a baseline leak off rate of the monitor well is obtained prior to fracturing of the active well. The gradual decrease in pressure within the monitor well over time, caused by fluid and pressure loss into the surrounding formation, is known as the leak off rate. The leak off rate is generally a function of the porosity and permeability of the formation surrounding the monitor well and the baseline leak off rate corresponds to the leak off rate of the monitor well when the active well is not being fractured and often will be done prior to initiation of fracturing of the active well. During completion of the active well, the leak off rate in the monitor well is compared to the baseline leak off rate and/or one or more other observed leak off rates, with the differences being the leak off rates being used to determine when and to what extent to control the fracturing operation. While much of the discussion herein references a comparison to a leak off rate, it is also possible to compare pressure in the monitor well to a discrete pressure value, a discrete flow value or some other discrete attribute of the monitor well indicative of an induced poroelastic effect between fractures forming from the active well and the monitor well.

Initial pressurization of the monitor well can be achieved in various ways. For example, the monitor well may be maintained under pressure following completion/fracturing of the monitor well. Alternatively, the monitor well may be pressurized by injecting fluid, such as water, into the monitor well. Notably, this latter approach facilitates the repurposing of dead or otherwise unused wells as monitor wells. In still other implementations, the monitor well may be a producing well. In implementations in which the monitoring well is a producing well, additional steps may be taken to facilitate use of the monitor well including, without limitation, one or more of adding water or other fluids to the monitor well, installing downhole gauges, and estimating hydrostatic pressure within the well based on the fluid being produced in the monitor well.

The foregoing discussion primarily described implementations of the present disclosure in which pressure changes within a monitor well result from poroelastic coupling with an active well that is being fractured and modifying fracturing operations based on such observations. In other implementations of the present disclosure, fracturing operations may be controlled, at least in part, in response to pressure changes induced in the monitor well due to direct fluid communication between the active well and the monitor well. Such direct fluid communication may occur as a result of a fracture fully extending between the active well and the monitor well, thereby enabling fracturing fluid to enter the monitor well. In such circumstances, the pressure response caused by the direct fluid communication may similarly be used to modify or otherwise control fracturing operations.

In still other implementations, control of fracturing operations is achieved without the use of a separate monitor well. Instead of using a monitor well, a portion of the active well is isolated and equipped with a pressure gauge or similar device for measuring pressure within the isolated section. Similar to the previously discussed monitor well, the isolated section may also include a transducer fracture extending into the surrounding subterranean formation. When an uphole section of the well is subsequently fractured, a pressure response may be observed within the isolated section due to poroelastic coupling between the fractures extending from the uphole section and the transducer fracture extending from the isolated section. This pressure response may subsequently be used to control modify or otherwise control fracturing operations.

FIG. 1 is a schematic diagram of an example well completion environment 100 for completing a fracturing operation in accordance with the present disclosure. The well completion environment 100 includes a subsurface formation 106 through which an active well 120 and a monitor well 122 extend. The active well 120 includes a vertical active well section 102 and a horizontal active well section 104. Similarly, the monitor well 122 is also a horizontal well and includes a vertical monitor well section 108 and a horizontal monitor well section 110.

The monitor well 122 includes at least one transducer fracture 142 extending toward the active well 120 with the area from the tip of the transducer 142 fracture rearward toward the monitor well defining a poroelastic region 134. The poroelastic region 134 corresponds to a portion of the subsurface formation 106 where the active well 120 is poroelastically couplable with the monitor well 122. Poroelastic coupling, as used herein, refers to a physical phenomenon in which two regions within or adjacent to a porous material are arranged such that when a force is applied to one region, the force is transmitted, at least in part, to the second region as a result of the poroelastic properties of the material. Accordingly, the poroelastic region 134 corresponds to a region within the subsurface formation 106 and adjacent a fracture of the monitor well 122 in which the active well 120 and the monitor well 122 may be poroelastically coupled to each other. As described below in more detail, such poroelastic coupling occurs when a fracture formed adjacent the active well 120 propagates and overlaps a fracture of the monitor well 122, referred to herein as a transducer fracture 142, enabling observations of pressure or other response within the monitor well 122 during fracturing of the active well 120. Hence, the monitor well 122 includes at least one transducer fracture 142 extending toward the active well 120 such that a region from the tip of the transducer fracture 142 rearward toward the monitor well 122 defines the poroelastic region 134.

The active well 120 includes an active wellhead 124 disposed at a surface 130. Similarly, the monitor well 122 includes a monitor wellhead 126 at the surface 130. The monitor wellhead 126 further includes a pressure gauge 144 for measuring pressure within the monitor well 122. In certain implementations, instead of or in addition to the pressure gauge 144, the monitor wellhead 126 includes a pressure transducer configured to transmit pressure data from the monitor wellhead 126 to a computing system 150. In the well completion environment 100, the computing system 150 is communicatively coupled to a pumping system 132 (illustrated in FIG. 1 as including a pumping truck 135) such that the computing system 150 can transmit pressure data, control signals, and other data to the pumping system 132 to dynamically adjust parameters of the fracturing operation based on pressure measurements received from the monitor wellhead 126. The pumping system 132 generally provides fracturing fluid into the active well 120 and, in certain implementations, may include additional equipment for modifying characteristics of the fracturing fluid and/or the manner in which the fracturing fluid is injected into the active well 120. Such equipment may be used, for example, to add or change a proppant or other additive of the fracturing fluid in order to modify, among other things, the viscosity, proppant concentration, proppant size, or other aspects of the fracturing fluid. Accordingly, such equipment may include, without limitation, one or more of tanks, pumps, filters, and associated control systems. The computing system 150 may include one or more local or remote computing devices configured to receive and analyze the pressure data to facilitate control of the fracturing operation.

The computing system 150 may be a single computing device communicatively coupled to components of the well completion environment 100, or forming a part of the completion environment 100, or may include multiple, separate computing devices networked or otherwise coupled together. In the latter case, the computing system 150 may be distributed such that some computing devices are located locally at the well site while others are maintained remotely. In certain implementations, for example, the computing system 150 is located locally at the well site in a control room, server module, or similar structure. In other implementations, the computing system is a remote server that is located off-site and that may be further configured to control fracturing operations for multiple well sites. In still other implementations, the computing system 150, in whole or in part, is integrated into other components of the well completion environment 100. For example, the computing system 150 may be integrated into one or more of the pumping system 135, the active wellhead 124, and the monitor wellhead 126. The pressure gauge 144 is configured to measure pressure within the monitor well 126 during fracturing of the active well 120. As shown in the well completion environment 100, the pressure gauge 144 is coupled to the monitor wellhead 126.

The pressure gauge 144 is communicatively coupled to the computer system 150, such as by a pressure transmitter. In alternative implementations, the pressure gauge 144 may be replaced or supplemented with other pressure measurement devices. For example, in certain implementations, pressure may be measured using, without limitation, one or more digital and/or analog pressure gauges coupled to the monitor wellhead 126, downhole pressure transmitters disposed within the monitor well 124, and pressure sensors incorporated into one or more flow meters (such as differential pressure flow meters). The pressure measurement device may be permanently fixed into casing, coiled tubing, or other structure disposed within the active well 120 or may be temporarily inserted into the active well 120 using, for example, a wireline or other conveyance. In still other implementations, other measuring devices may be used to indirectly determine pressure within the monitor well 120, such as by measuring a temperature within the monitor well 120 that is then used to determine pressure within the monitor well 120.

Well completion environment 100 is depicted after perforation but before fracturing of the active well 120. Accordingly, active well horizontal section 104 includes a plurality of perforations 138 extending into subsurface formation 106 and, more specifically, towards the poroelastic region 134. The entire formation surrounding the wellbores may demonstrate poroelasticity. The term poroelastic region is meant to refer to the area, typically between the wellbores, where a propagating fracture from the active wellbore may overlap a fracture (e.g., the transducer fracture 142) extending from the monitor well 122 and produce a poroelastic response in the monitor well 122. The perforations 138 are formed during completion of the active well 120 to facilitate introduction of fracturing fluid into the subsurface formation 106 adjacent the horizontal active well section 104. For example, in certain completion methods, casing is installed within the well and a perforating gun is positioned within the active well 120 adjacent the portion of the subsurface formation 106 to be fractured. The perforating gun includes shaped charges that, when detonated, create perforations that extend through the casing and into the adjacent formation, thereby creating an initial fluid path from the subsurface formation 106 into the active well 120. During fracturing, fracturing fluid is pumped into the active well 120 and the fluid passes through the perforations 138 under high pressures and rate. As pressure increases, the fracturing fluid injection rate increases through the perforations 138, forming fractures that propagate through the subsurface formation 106, thereby increasing the size and quantity of fluid paths between the subsurface formation 106 and the active well 120. In contrast to the active well 120, the monitor well 122 is previously completed and includes one or more fractures 140. It is also possible that the monitor well 122 intersects one or more preexisting fractures, which may serve as transducer fractures. Hence, the monitor well 122 includes at least one transducer fracture 142 extending toward the active well 120 with the area from the tip of the transducer fracture 142 rearward toward the monitor well being the poroelastic region 134.

Alternative fracturing methods may also be used in conjunction with the systems and methods disclosed herein. For example, in certain implementations, the fracturing operation is an open-hole fracturing operation. In contrast to methods in which a casing is installed and then perforated prior to fracturing, open-hole fracturing is performed on an unlined section of the wellbore. Generally, open-hole fracturing involves isolating sections of the uncased wellbore using packers or similar sealing elements. Sliding sleeves or similar valve mechanisms disposed between the packers are then opened to permit pumping of the fracturing fluid into the surrounding formation. As pressure within the formation increases, fractures are formed and propagated. In multistage wells, this process is repeated for each stage moving up the wellbore.

The active wellhead 124 is coupled to a pump system 132 for pumping fracturing fluid into the active well 120. In the well completion environment 100, for example, the pump system 132 includes a pump truck 135 coupled to the active wellhead 124. The pump truck 135 includes a tank or other means for storing the fracturing fluid and a pump couplable to the active wellhead 124 for pumping fluid into the active well 120. In other embodiments, the pump system 132 includes other equipment for providing fracturing fluid to the active well 120 including, without limitation, storage tanks or other vessels and one or more additional pumps. The pump system 132 may further include equipment configured to modify the fracturing fluid, for example, by adding one or more additives, such as proppants, to the fracturing fluid. The pump system 132 may also include equipment, such as filters, to treat and recycle fracturing fluid. As shown in the implementation of FIG. 1, the pump system 132, and more particularly pump truck 135, is communicatively coupled to the computing system 150. Accordingly, the pump truck 135 can receive sensor data, control signals, or other data from the computing system 150, including data configured to be used in control and monitoring of an ongoing fracturing operation.

During fracturing, fracturing fluid is pumped by the pumping system 132 into the active well 120. The fracturing fluid enters the subsurface formation 106 through the perforations 138. As the fracturing fluid continues to enter the subsurface formation 106, pressure within a portion of the subsurface formation 106 adjacent the perforations 138 increases, leading to the formation and propagation of fractures within the subsurface formation 106. As the fractures from the active well 120 propagate into the poroelastic region 134, the active well 120 and the monitor well 122 become poroelastically coupled. More specifically, one or more dominant fractures (such as the dominant fracture 212 illustrated in FIG. 2A) from active well 120 extend into the poroelastic region 134 and overlaps the transducer fracture 134 of the monitor well 122. As a result, the active well 120 and the monitor well 122 become poroelastically coupled such that forces applied to the subsurface formation 106 by injection of the fracturing fluid into the active well 120 are transmitted through the poroelastic region 134 and applied to the transducer fracture 142 of the monitor well 122. The transmitted forces create a pressure response in the monitor well 122 that may be measured using pressure gauge 144 or other pressure measurement device and used to dynamically adjust the fracturing operation. For example, in one embodiment, measurements from pressure gauge 144 are used to determine when to initiate a rate cycle (or change to one or more other fracturing operation parameters) during the fracturing operation. Additional details regarding the relationship between pressure in the monitor well 122 and control of the fracturing operation are discussed below in more detail with respect to FIG. 2A.

In alternative implementations of the present disclosure, one or both of the active well 120 and the monitor well 122 are vertical wells. Moreover, implementations of the present disclosure may include more than one active well and/or more than one monitor well. For example, multiple monitor wells may be used to monitor fracturing of one active well.

In addition to or instead of poroelastic coupling of the active well 120 and the monitor well 122, the active well 120 and the monitor well 122 may be directly coupled such that they are in direct fluid communication with each other. For example, during the fracturing operation, a fracture extending form the active well 120 may intersect one or more of the transducer fracture 142, a different fracture of the monitor well 122, and the monitor well 122 itself. In such instances, pumping of fracturing fluid into the active well 120 will induce a pressure response in the monitor well 122 that may be used to actively control the corresponding fracturing operation. Notably, the active well 120 and the monitor well 122 may be both poroelastically coupled and in direct fluid communication with each other such that the pressure response observed in the monitor well 122 is a result of both poroelastic coupling and direct coupling. Additionally, depending on the porosity of the formation and other factors, pumping fluid into the active well 120 may generate some pressure response in the monitor well 122 without poroelastic coupling or direct fluid communication. For example, after pumping of fracturing fluid for a particular stage has been completed, the recently injected fracturing fluid may leak off into the monitor well 122 creating a pressure response within the monitor well 122 independent of poroelastic coupling.

As noted above, well completion environment 100 includes one active well 120 and one monitor well 122. In alternative implementations, well completion environments in accordance with this disclosure may include more than one of either active wells or monitor wells. For example, in certain implementations, multiple monitor wells may monitor fracture growth in one or more active wells. Because each monitor well has a different location and orientation, each monitor well would therefore identify fracture growth in different directions. Similarly, one monitor well may be used to monitor fracture growth in multiple active wells. For example, one active well may be positioned between two or more active wells such that the monitor well is poroelastically couplable and provides a pressure response when fracturing any of the active wells.

Figure 2A:
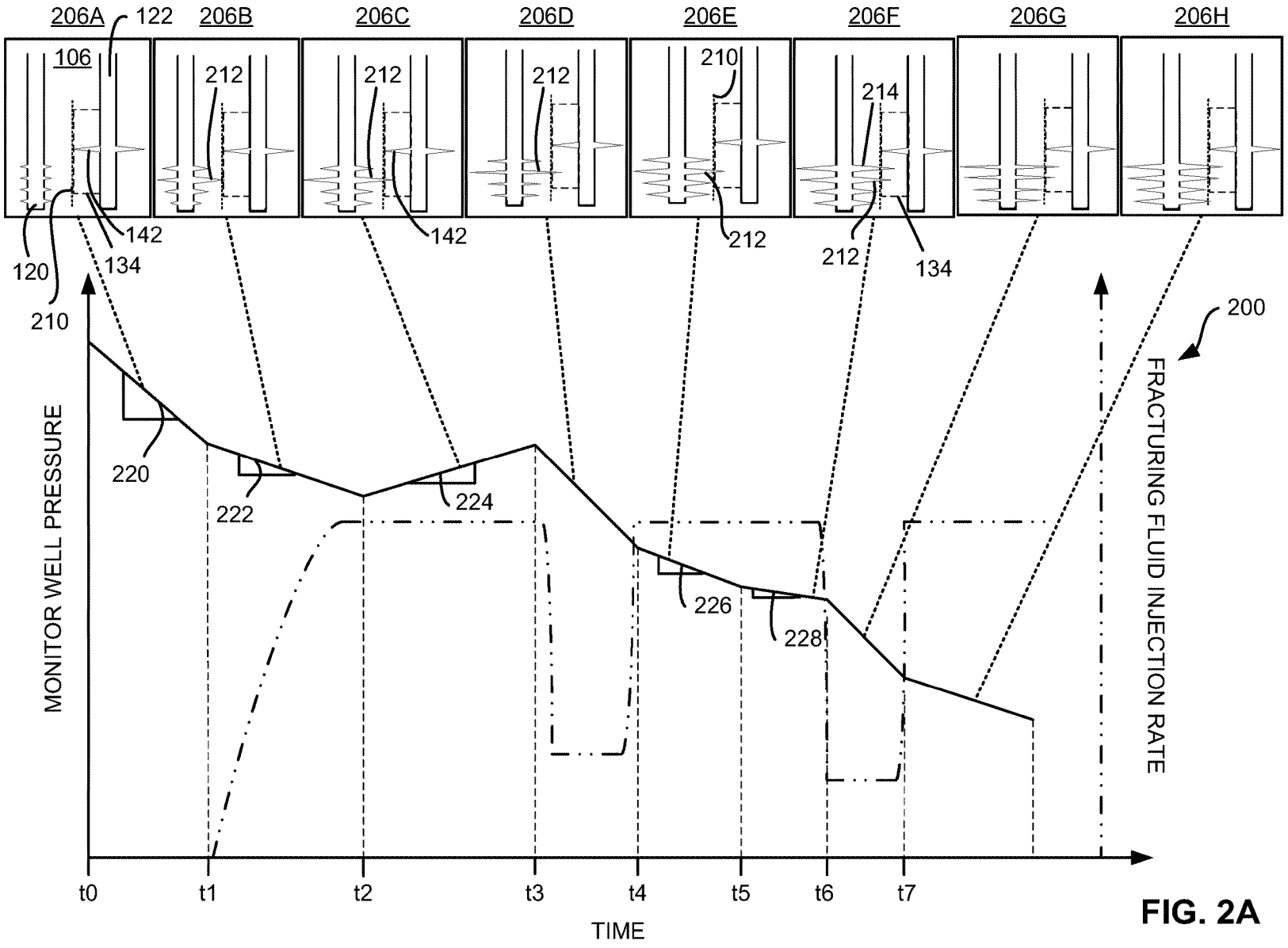
FIG. 2A is an example graph illustrating monitor well pressure and fracturing fluid flow rate over time during a fracturing operation.

FIG. 2A is an example graph 200 illustrating monitor well pressure and fracturing fluid flow rate over time during a fracturing operation according to the present disclosure. For explanatory purposes, the following description of FIG. 2A references components of the well completion environment 100 of FIG. 1. Accordingly, the graph 200 includes a pressure line 202 (shown as a solid line) corresponding to pressure readings obtained from a pressure gauge 144 or transducer configured to measure pressure within the active well 122 and a flow rate line 204 (shown as a periodic dashed line) corresponding to the flow rate of fracturing fluid provided by a pumping system 132 into the active well 120 during the fracturing operation. FIG. 2A further includes a set of schematic illustrations 206A-H. The illustrations 206A-H depict, during various stages of the fracturing operation, each of the horizontal active well section 104, the horizontal monitor well section 110, the poroelastic region 134 disposed between the active well 120 and the monitor well and a plane 210 (to not unnecessarily obscure the illustrations not every feature is labeled in each illustration). The plane 120 corresponds to the point in the poroelastic region 134 beyond which the active well 120 and the monitor well 122 become poroelastically coupled. Accordingly, as a fracture from the active well 120 propagates beyond the plane 120, a pressure response becomes observable within the monitor well 122 due to poroelastic coupling. For purposes of simplicity, only the transducer fracture 142 of the monitor well 122 is depicted in illustrations 206A-H.

The fracturing operation depicted in the graph 200 of FIG. 2A generally illustrates an implementation of systems and methods described herein for controlling rate cycling of a fracturing operation. More specifically, the fracturing operation controls rate cycling of a fracturing operation in the active well 120 based on pressure changes (and/or lack of pressure changes) observed in the monitor well 122, where the changes in the rate of pressure change are due to poroelastic coupling of the active well 120 and the monitor well 122. As previously discussed, rate cycling generally involves pumping fracturing fluid into a subterranean formation at other than a steady flow rate. Accordingly, the pressure changes observed in the monitor well 122 are used to trigger various changes in the flow rate of fracturing fluid pumped into the active well 120. In other implementations, changes in pressure within the monitor well 122 can be used to control other parameters of the fracturing operation alone or in combination with parameters relating to rate cycling. For example, and without limitation, changes in pressure within the monitor well 122 can be used to control one or more fracturing operation parameters including, without limitation, the pressure at which fracturing fluid is pumped into the active well 122, the concentration of proppants or additives within the fracturing fluid, the density of the fracturing fluid, and the type of fracturing fluid used. In many cases, such changes may further be coordinated with rate cycling but may not occur at the same times as rate is changed. For example, one or more of the fluid pressure, proppant/additive concentration, fluid density, and type of fracturing fluid may be changed as the fluid flow rate is increased or decreased at the beginning or end of a rate cycle or at any time after the target rate for the rate cycle is achieved.

Referring now in more detail to FIG. 2A, during time interval t0 to t1, a baseline leak off rate for monitor well 122 is obtained. The baseline leak off rate is the rate at which pressure within monitor well 122 declines absent influence from the active well 120. More particularly, the baseline leak off rate is the rate at which pressure reduces within monitor well 122 absent pressure effects attributable to pumping fracturing fluid into the active well 120 due to poroelastic coupling of the active well 120 and the monitor well 122. The baseline rate is indicated in the graph 200 by a baseline slope 220.

After a baseline leak off rate is established, fracturing fluid is pumped into the active well 122. More specifically, during interval t1 to t2, the pump system 132 is activated and the flow rate of fracturing fluid into the active well 120 is increased until a first flow rate is reached at time t2. As illustrated in the transition between schematic illustration 206A and 206B, the introduction of fracturing fluid into active well 120 induces propagation of fractures originating from the active well 122, including the formation of a first dominant fracture 212. As fluid is pumped into the active well 122 at an increasing flow rate, the first dominant fracture 212 begins to enter the poroelastic region 134 by crossing the plane 120 indicating when poroelastic coupling occurs. During this ramp up period, a pressure increase is observed within the monitor well 120 because of the poroelastic coupling between the first dominant fracture 212 and the transducer fracture 142. This pressure increase is illustrated in the graph 200 as a reduction in slope of the pressure line between times t1 and t2. The rate of pressure change during time interval t1 to t2, illustrated by a first slope 222, is reduced as compared to the baseline slope 220 observed during time interval t0 to t1. Notably, the first slope 222 is still negative, indicating that pressure within the monitor well 122 is still declining despite the pressure effects caused by the fracturing fluid. However, the rate at which the pressure is declining during time interval t1 to t2 is less than that observed during time t0 to t1.

At time t2 (and as shown in illustration 206C) the first flow rate is reached and the first dominant fracture 212 continues to propagate and further overlap the transducer fracture 142. As indicated in time interval t2 to t3, achieving the first flow rate and the corresponding progression of the first dominant fracture 212 into the poroelastic region 134 results in an even greater increase of pressure within monitor well 122 as compared to the pressure increase observed during time interval t1 to t2. In the example provided, the pressure increase experienced during time interval t2 to t3 is significant enough to cause the pressure within monitor well 122 to increase between time t2 and t3 as indicated by a second, positive slope 224.

At time t3, a rate cycle is initiated by reducing the fracturing fluid flow rate provided by the pumping system 132. The reduction in fracturing fluid flow rate induces a relaxation of the poroelastic region 134 and a corresponding reduction in pressure within the monitor well 122. Accordingly, the leak off rate (i.e., the change in pressure of the monitor well 122 over time) during time interval t3 to t4 substantially returns to the baseline leak off rate measured during time interval t0 to t1. As shown in illustration 206D, relaxation of the poroelastic region 134 may further result in closure, in whole or in part, of fractures within the subterranean formation 106, including the first dominant fracture 212.

Figure 2B:
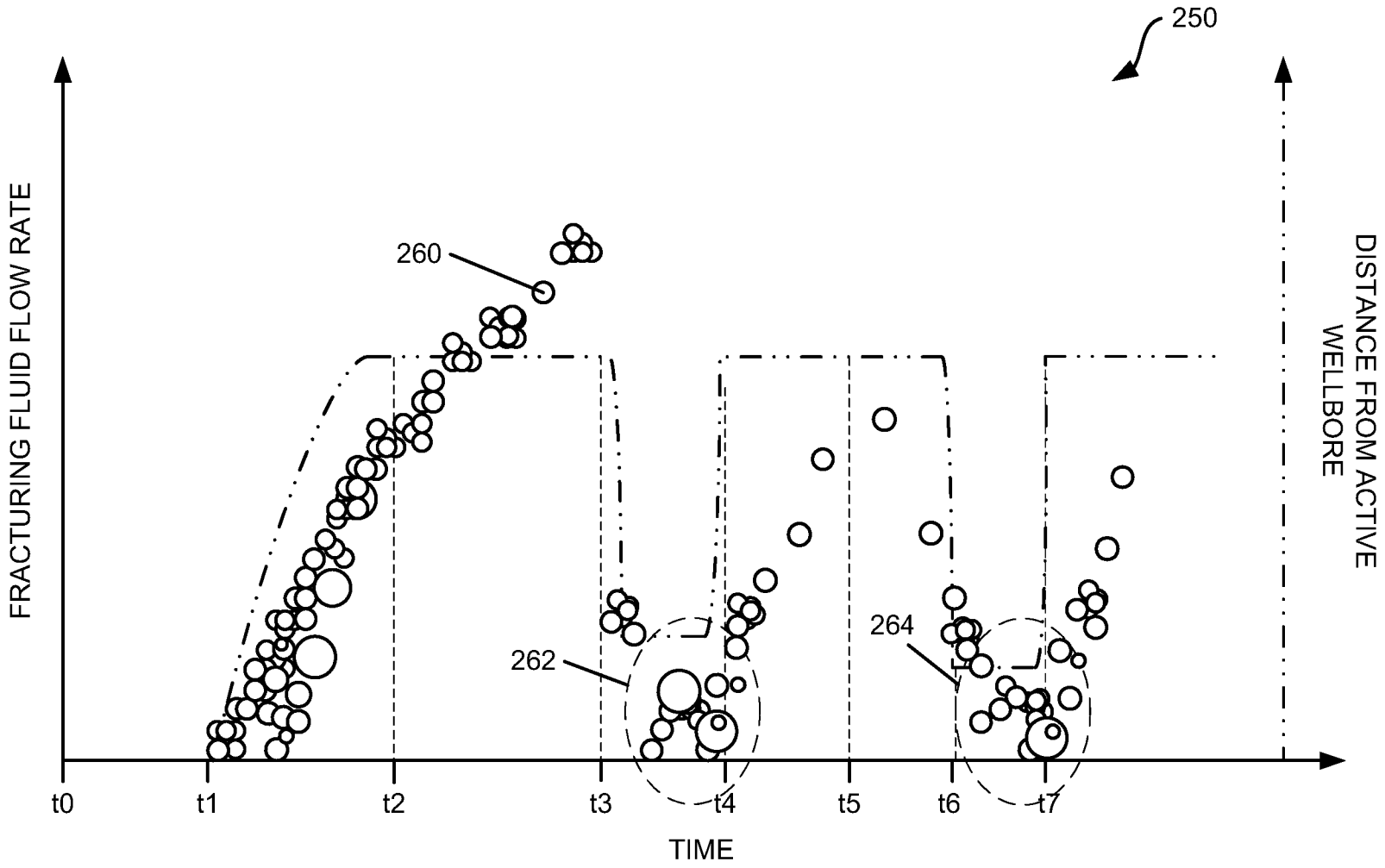
FIG. 2B is a second example graph illustrating microseismic data corresponding to the fracturing operation illustrated by the graph of FIG. 2A.

FIG. 2B is a second graph 250 illustrating additional data corresponding to the fracturing operation illustrated by graph 200 of FIG. 2A and, more specifically, additional data corresponding to the occurrence of microseismic events within the active well 120 during the fracturing operation of FIG. 2A. The data illustrated in the second graph 250 generally corresponds to experimental results observed during fracturing operations similar to that depicted in FIG. 2A. Microseismic events are represented in the second graph 250 as circular indicators, such as indicator 260, with the relative magnitude of the microseismic event indicated by the relative size of each indicator. As illustrated in the second graph 250, initial fracturing of the active well 120 occurs between time interval t1 to t3 and results in microseismic events displaced progressively farther into the subterranean formation from the active wellbore. When the flow of fracturing fluid is reduced at time t3, microseismic events occur nearer the active wellbore, as indicated by a first cluster 262. The microseismic events are generally the result one or more of closure of fractures formed during the prior high flow rate cycle and the formation of new fractures and/or propagation of existing fractures closer to the active wellbore. As described in more detail below, a second rate cycling occurs at time interval t7. The second rate cycling results in a second cluster 264 of microseismic events near the wellbore. Similar to the first cluster 262, the second cluster 264 generally corresponds to closure of fractures formed in the previous high flow rate period (i.e., time interval t4 to t5), or formation of new fractures or propagation of existing fractures near the wellbore. The closure of fractures or slowing of growth during a rate cycle aids in the treatment of smaller, non-dominant fractures by diverting the fracturing fluid away from the dominant fracture. More specifically, the energy required to reinitiate the slowed or closed fracture may exceed that required to begin propagating one of the other smaller, non-dominant fractures. The opening of fractures near the wellbore results in higher fracture intensity and/or complexity near the wellbore and, as a result, greater production from the well.

At time t4, a second fracturing cycle is initiated by increasing the fracturing fluid flow rate to that used during time interval t2 to t3. Similar to time interval t2 to t3, the increased flow rate of fluid into the active well 120 induces a pressure increase within the monitor well 122, as indicated by a third slope 226 which is less negative than the baseline slope 200. Notably, the third slope 226 is also more negative than the second slope 224 observed during time interval t2 to t3 (i.e., during formation and propagation of the first dominant fracture 212). Based on the difference between the second slope 224 and the third slope 226 and the fact that the fracturing fluid flow rate is substantially identical during the two time intervals, it can be inferred that the first dominant fracture 212 is receives a lesser proportion of the fracturing fluid being pumped into the active well 120. In other words, a higher proportion of the fracturing fluid is being diverted to secondary fractures, promoting propagation of the secondary fractures.

As noted above, allowing fractures within the subterranean formation to partially or completely close promotes fracturing fluid flow into secondary fractures nearer the wellbore. In certain implementations, the increased diversion of fracturing fluid to secondary fractures observed during time interval t4 to t5 is achieved without the use of known chemical or mechanical diversion techniques, thereby resulting in improved efficiency of the well completion process. In chemical diversion, for example, a first fluid is pumped into the wellbore that solidifies and seals certain fractures in order to divert fracturing fluid to other, unsealed fractures or portions of the wellbore. Following fracturing, a second fluid is pumped into the well to dissolve the first fluid. Similarly, in mechanical diversion, a mechanical device, such as a ball or packer assemblies, is used to temporarily plug a first portion of the wellbore to divert fracturing fluid to a second portion of the wellbore. Subsequently, the mechanical device must be either dissolved or drilled out to reestablish fluid communication with the first portion of the wellbore. Each of these traditional diversion methods requires additional fluid pumping cycles and/or tool runs, resulting in increased completion time and costs.

As the secondary fractures propagate, one of the secondary fractures may overtake the first dominant fracture 212. As shown in illustration 206F and indicated by time interval t5 to t6, a second dominant fracture 214 has propagated into the poroelastic region 134 and overtaken the first dominant fracture 212. Overtaking by one of the secondary fractures may be observed as a variation in the rate of pressure change within the monitor well 122. In the graph 200, the fourth slope 226 corresponds to a rate of pressure change when the first dominant fracture 212 is dominant. Accordingly, if a rate of pressure change is observed within the monitor well 122 that differs from the fourth slope 226, it can be inferred that a secondary fracture has overtaken the first dominant fracture 212. In the graph 200, the rate of pressure change within the monitor well changes at time t5 to a fifth slope 228, indicating a change in the growth rate of the dominate fracture, potentially being the emergence of a new dominant fracture, i.e., the second dominant fracture 214. Unlike the pressure increase experienced during time interval t2 to t3, the pressure increase induced during time interval t5 to t6 is insufficient to cause an increase in pressure within the monitor well 122 but merely causes a further decrease in the leak off rate.

At time t6, a second rate cycle is initiated by reducing the fracturing flow rate for a second time. This reduction induces another relaxation of the poroelastic region 134, facilitating a return of the monitor well 122 to the baseline leak off rate observed during time interval t0 to t1. At time t7, a third fracturing cycle is initiated by increasing the fracturing fluid flow rate.

The process of cycling fracturing fluid flow rate can be repeated as many times as required to achieve sufficient fracturing of the subsurface formation 106. Whether sufficient fracturing of the subsurface formation 106 has been achieved may be determined using various techniques including, without limitation, counting the occurrence of a predetermined number of rate cycles, pumping a predetermined volume of the fracturing fluid into the active well, pumping the fracturing fluid for a predetermined time, observing temperature changes within the subterranean formation, and observing microseismic events within the subterranean formation. In certain implementations, completion of the fracturing operation may be determined by pressure responses in the monitor well. For example, the fracturing operation may be deemed completed when subsequent rate cycling does not induce variable pressure responses in the monitor well 122 or any pressure response at all. Such behavior of the monitor well 122 may indicate that either fracturing fluid is no longer being diverted to fractures other than the dominant fracture or that the majority of fractures from the active well already overlap the transducer fracture.

Figure 3:
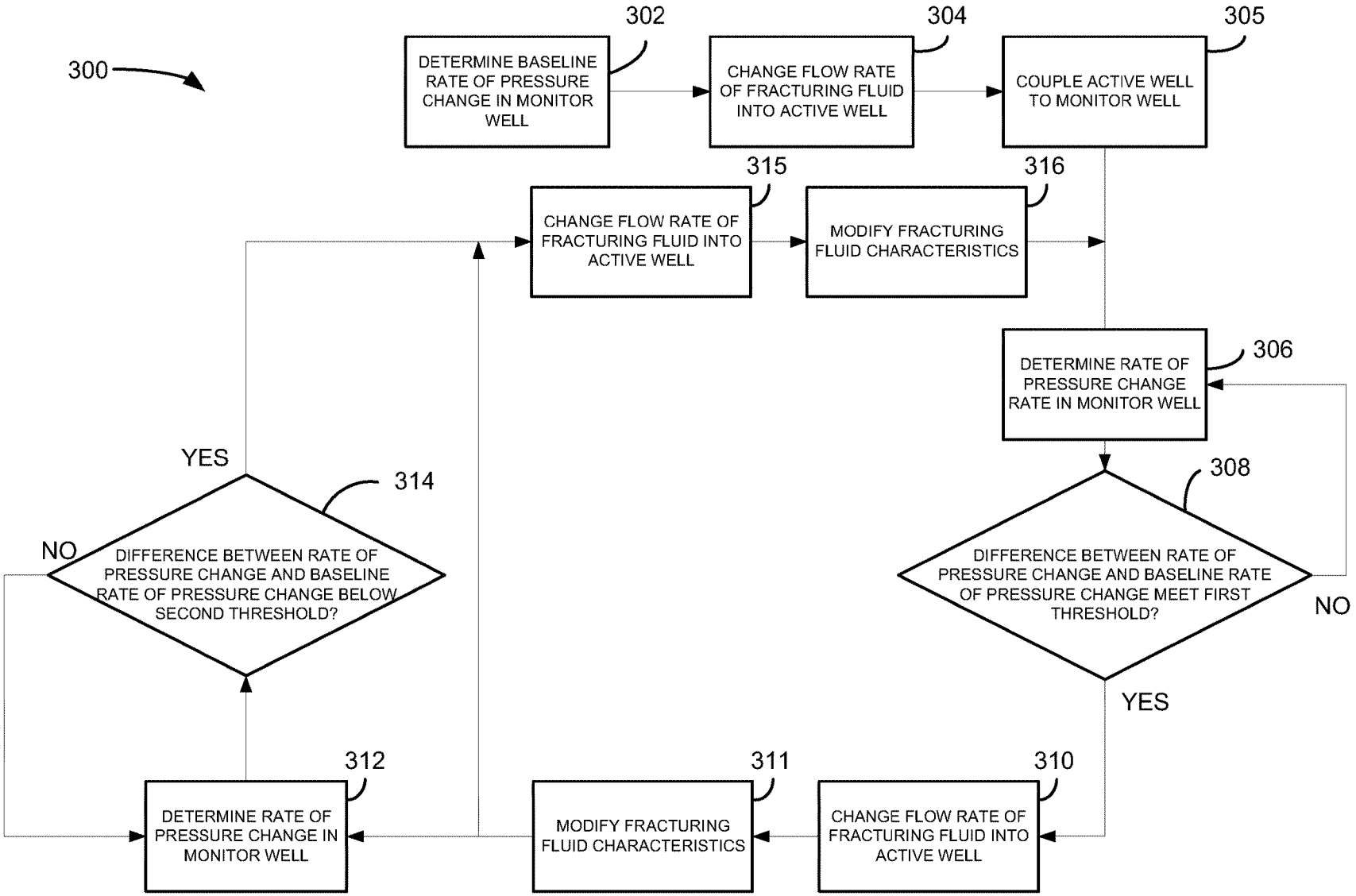
FIG. 3 is a flow chart illustrating an example method for controlling rate cycling during a fracturing operation.

FIG. 3 is a flow chart illustrating an example method 300 for controlling rate cycling during a fracturing operation. With reference to the well completion environment 100 (shown in FIG. 1), example method 300 includes an operation 302 that determines a baseline rate of pressure change in the monitor well 122. Determining the baseline rate of pressure change may include observing pressure within the monitor well 122 over time, such as by referring to pressure measurements obtained from a pressure gauge 144 coupled to a monitor wellhead 126 over a known time interval. In certain implementations, the baseline rate of pressure change corresponds to a leak off rate of the monitor well 122.

Prior to obtaining a baseline pressure rate change, the monitor well 122 may be pressurized. In certain implementations, pressurization of the monitor well 122 occurs as a result of completion of the monitor well 122. For example, the monitor well 122 is pressurized as a result of a fracturing operation applied to the monitor well 122. In other implementations, the monitor well 122 may be pressurized by injection of fluid, such as water, into the monitor well 122. In one specific example, the monitor well may be filled with water and the leak off rate measured thereafter. The volume of fluid (water) in the well provides hydrostatic pressure sufficient to measure leak off rate, in one example.

After obtaining a baseline rate of pressure change and coupling, an operation 304 changes the flow rate of fracturing fluid into a well to be fractured, such as the active well 120 shown in FIG. 1. More particularly, after the baseline rate of pressure change is obtained, the flow rate of fracturing fluid into the active well 120 is increased. In one implementation, a pumping system 132 injects the fracturing fluid into the active well 120. Stated differently, fracturing may be initiated in the active well while at the same time monitoring pressure, or some other parameter sufficient to infer a poroelastic effect between the monitor and the active well, at the monitor well.

As fracturing fluid is pumped into the active well 120, an operation 305 couples the active well 120 to the monitor well 122. In certain implementations, the coupling operation includes poroelastically coupling the active well 120 to the monitor well 122. In alternative implementations, the active well 120 and the monitor well 122 are directly coupled and in fluid communication instead of or in addition to being poroelastically coupled.

Subsequent operations 306, 308 identify or otherwise determine the rate of pressure change in the monitor well 122 and whether the difference between the rate of pressure change in the monitor well 122 and the baseline rate of pressure change obtained during operation 302 exceeds a first predetermined threshold. As long as the difference does not exceed the first predetermined threshold, operations 306 and 308 are repeated, either continuously or at discrete time intervals. In other words, the rate of pressure change within the monitor well 122 is observed and compared to the baseline rate of pressure change to determine when injecting fracturing fluid into the active well 120 creates a pressure response in the monitor well 122. The pressure response observed in the monitor well 122 is due, at least in part, to the poroelastic coupling between the active well 120 and the monitor well 122 and the transmission of pressure from the active well 120 to the monitor well 122 through the poroelastic region 134.

The present disclosure contemplates any number of possible fracturing fluid pumping parameter changes based on the pressure response in the monitor well. The difference in slope may be used, the time at which some difference is maintained, the degree of change in pressure, as well as other factors. Hence, various possible parameters and combination of parameters may be used as a threshold. Similarly, the number and type of response to the change may be any number of possibilities. For example, one rate cycle may occur, stepped cycles may occur, cycles may occur at different intervals and to different degrees, other changes, such as proppant or viscosity changes may be coordinated with the changes.

When the observed difference between the dynamically measured rate of pressure change and the base line rate of pressure change exceeds the predetermined threshold, an operation 310 changes the flow rate of fracturing fluid into the active well 120. In certain implementations, the flow rate is decreased to a lower flow rate, including no flow, for a predetermined period of time. In such implementations, the previously injected fluid may be permitted to flow from the active well into a tank or other storage system. In still other embodiments, the flow rate may be increased.

In addition to changing the flow rate of fracturing fluid into the active well 120, an operation 311 to modify characteristics of the fracturing fluid may be carried out. For example, and without limitation, one or more of the density, viscosity, proppant type, proppant concentration, additive concentration, and other characteristics of the fracturing fluid may be modified in response to the rate of pressure change observed in the monitor well.

In certain implementations, an operator may manually change the flow rate of fracturing fluid provided by the pumping system 132 in response to a system generated prompt. For example, the system 150 may generate commands or prompts, in response to some change in the monitor well pressure, guiding the operator to adjust the flow rate provided by the pumping system 132. Commands may be sent directly to the pumping system 132 or may generate an alert, prompt, or similar response on a control panel, graphical user interface, or other device of a user of the pumping system 132. In alternative embodiments, the pumping system 132 is communicatively coupled to a computing device, such as the computing system 150 of FIG. 1, that is configured to receive pressure measurements from the monitor well 122 and to provide control signals to the pumping system 132.

In certain implementations, the fracturing fluid flow rate is reduced during operation 310. After reduction of the fracturing fluid flow rate, operations 312, 314 determine the rate of pressure change in the monitor well 122 and whether the difference between the rate of pressure change in the monitor well 122 and the baseline rate of pressure change obtained during operation 302 are below a second predetermined threshold. As long as the difference is above the second predetermined threshold, operations 306 and 308 are repeated, either continuously or at discrete time intervals. In other words, the rate of pressure change within the monitor well 122 is observed and compared to the baseline rate of pressure change to determine when the pressure response observed in the monitor well 122 has subsided, thereby indicating sufficient relaxation of the poroelastic region 134 between the active well 120 and the monitor well 122. After such subsidence, the fluid flow rate of the fracturing fluid and the fracturing fluid characteristics are again modified in operations 315 and 316, respectively, thereby initiating a second rate cycle. Subsequent cycles may be conducted until sufficient fracturing of the active well 120 is achieved.

In alternative implementations, the duration for which a flow rate is maintained before rate cycling can be based on observations of microseismic events within the active well 120. As previously discussed in the context of FIGS. 2A and 2B, reducing the flow rate of the fracturing fluid pumped into the active well 120 generally leads to the occurrence of microseismic events near the wellbore, which generally indicate closure of fractures or formation and/or propagation of fractures other than the dominant fracture. Accordingly, observation of such microseismic events may be used to determine when to increase the flow rate of fracturing fluid. For example, in certain implementations the flow rate of the fracturing fluid is increased when one or more microseismic events occurs having a minimum predetermined magnitude and/or within a predetermined distance from the wellbore. Alternatively, a flow rate may be maintained for some period of time and/or at some prescribed level prior to rate cycling. Hence, a second threshold is not used to determine when to change flow rates.

Method 300 is intended only as an example embodiment of a method in accordance with the present disclosure and alternative implementations are possible. In one alternative implementation, flow rate of the fracturing fluid is increased and/or decreased in response to the difference between the baseline rate of pressure change and the observed rate of pressure change being maintained for a predetermined amount of time. In still other implementations, other parameters may be modified in addition to or instead of the flow rate of the fracturing fluid. Such parameters include, without limitation, the type of fracturing fluid being used, the relative proportion of components of the fracturing fluid, the amount or type of proppant added to the fracturing fluid, and the amount or type of other additive either added to or excluded from the fracturing fluid. Moreover, modifications to any parameters associated with the fracturing operation may vary from rate cycle-to-rate cycle. For example, the flow rates used during one rate cycle may differ from prior or subsequent rate cycles.

In certain implementations, properties of the fracturing fluid including, without limitation, one or more of the density, viscosity, proppant type, proppant concentration, additive concentration, and other characteristics of the fracturing fluid may be modified in response to the rate of pressure change observed in the monitor well 122. For example, rate cycling may induce only a minor variation or no variation in the rate of pressure change within the monitor well 122. Such minimal changes may indicate that a less than desirable amount of the fracturing fluid is being diverted away from the dominant fracture. To promote diversion of fracturing fluid, various techniques may be applied. For example, the size and/or concentration of proppant may be increased to promote bridging in the dominant fracture, thereby obstructing the flow of fracturing fluid into the dominant fractures. In another technique, the viscosity of the fracturing fluid may be changed. More specifically, a high viscosity fracturing fluid may be used to form a high viscosity "plug" in the dominant fracture that prevents or resists a subsequently injected low viscosity fluid from entering the dominant fracture.

The example implementation of the present disclosure illustrated in FIG. 1 included a wellhead 126 and corresponding pressure gauge 144 for measuring pressure within the monitor well 122. In the example, the monitor well 122 defines a single volume such that pressure changes induced by poroelastic coupling between the active well 120 and any portion of the monitor well 122 are reflected by the pressure gauge 144. In other implementations, however, a monitor well may be divided into isolated intervals with each interval having a respective pressure gauge (or similar sensor adapted to measure pressure) and a respective transducer fracture. By doing so, pressure responses in each interval may be monitored to detect fracture propagation through distinct portions of a subterranean formation. The pressure responses may then be used to modifying fracturing operation parameters, thereby controlling fracturing operations. An example of such an implementation is provided in the following discussion with reference to FIGS. 4 and 5.

Figure 4:
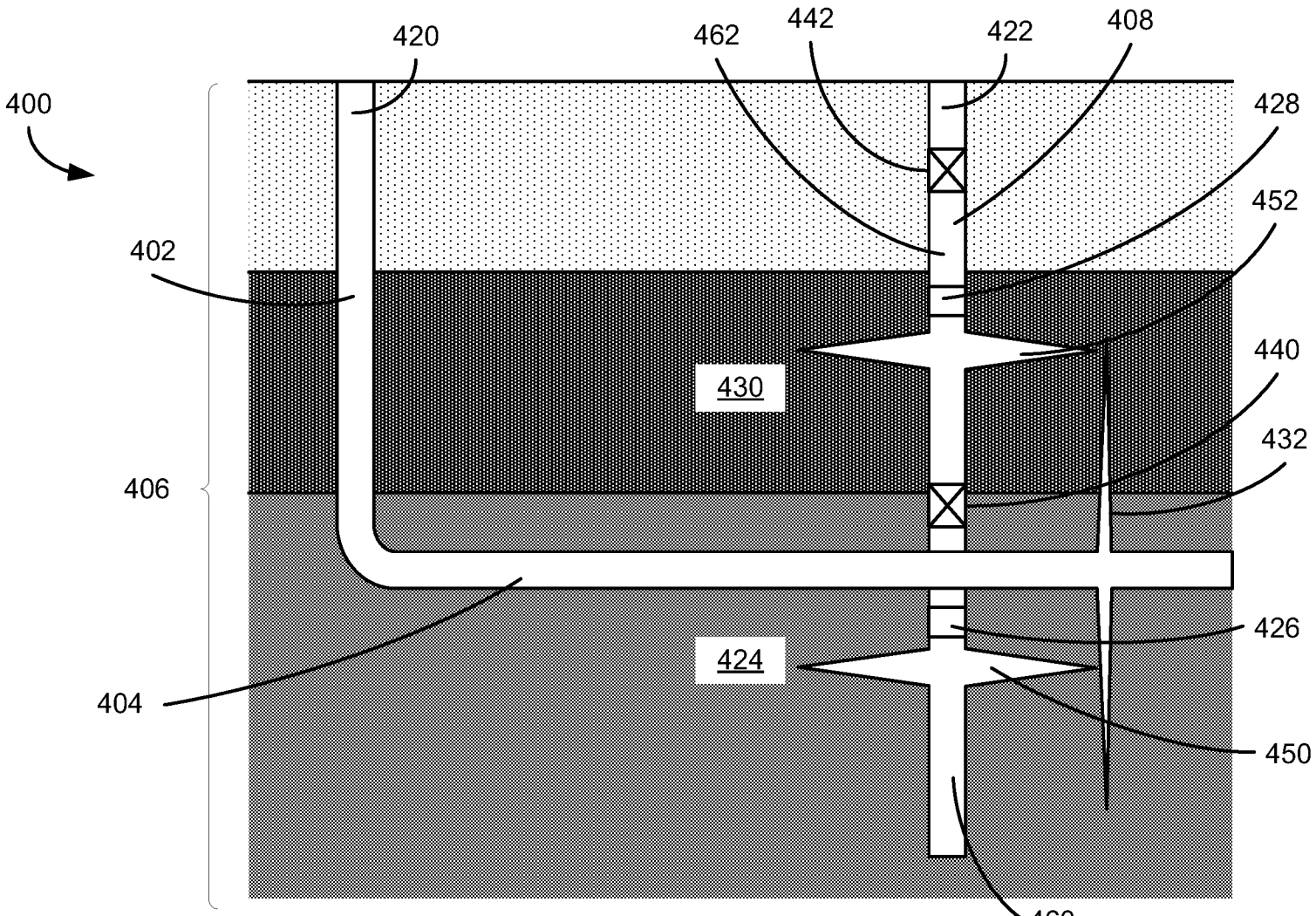
FIG. 4 is a schematic diagram of a second example well environment including multiple monitor well gauges.

FIG. 4 is a schematic diagram of a second example well completion environment 400 for completing a fracturing operation in accordance with the present disclosure. The well completion environment 400 includes a subsurface formation 406 through which an active well 420 and a monitor well 422 extend. The active well 420 includes a vertical active well section 402 and a horizontal active well section 404. As shown in FIG. 4, the horizontal active well section 404 extends through a first zone 424 of the subsurface formation 406.

In the example of FIG. 4, the monitor well 422 includes only a vertical well section 408. However, in other implementations, the monitor well 422 may include other sections extending in other directions, similar to the monitor well 122 of FIG. 1. The monitor well 422 is divided into a first, lower well interval 460 and a second, upper well interval 462. More specifically, isolation devices, such as isolation devices 440 and 442, are disposed within the monitor well 422 to define the well intervals 460, 462. The isolation devices 440, 442 may be, for example, plugs, packers, or other devices inserted at predetermined locations within the monitor well 422 to define the well intervals 460, 462. The monitor well 422 further includes pressure gauges or similar sensors to measure pressure within the well intervals 460, 462. More specifically, the monitor well 422 includes a lower pressure gauge 426 for measuring pressure within the first, lower interval 460 and an upper pressure gauge 428 for measuring pressure within the second, upper well interval 462.

As shown in FIG. 4, the subsurface formation 406 may be divided into one or more zones, such as a first zone 424 and a second zone 430. Each zone of the subsurface formation 406 generally corresponds to a zone-of-interest with respect to a well completion operation. For example, in certain instances, each zone may correspond to one of a pay zone, a zone including a hazard (such as a water source), or a zone having a particular geological structure or similar properties. In general, however, the zones 424, 430 are sufficiently isolated such that poroelastic coupling between the active well 420 and the monitor well 422 within each of the zones 424, 430 may be separately identified by a pressure response within a corresponding interval of the monitor well 422. For example, isolation between the zones 424, 430 may result from the zones 424, 430 being distinct strata of the subsurface formation 406, from one or more intermediate strata disposed between the zones 424, 430, or from the zones 424, 430 being at sufficiently different well depths.

By dividing the monitor well 422 into isolated and separately monitored intervals corresponding to distinct zones of the subsurface formation 406, propagation of fractures extending from the active well 420 may be tracked as those fractures extend through each of the zones of the subsurface formation 406. More specifically, as fractures from the active well 420 cross into different zones of the subsurface formation 406, the fractures become poroelastically coupled with intervals of the monitor well 422. Accordingly, by monitoring pressure responses within the intervals of the monitor well 422, the occurrence and approximate degree of propagation of a fracture into specific zones of the subsurface formation 406 may be determined.

Referring more specifically to the example of FIG. 4, the lower pressure gauge 426 and the upper pressure gauge 428 measure pressure within intervals 460 and 462 of the monitor well 422, respectively. During a fracturing operation a fracture 432 may be formed and propagate from the active well 420. As the fracture 432 extends through the zone 424 of the subsurface formation 406, the fracture 432 becomes poroelastically coupled to a lower transducer fracture 450 of the monitor well 422, resulting in a pressure response within the lower interval 460 that is measured by the lower pressure gauge 426. Because the lower zone 424 of the subsurface formation 406 is isolated from the upper zone 430 of the subsurface formation 406, a corresponding pressure increase is not observed within the second well interval 462. However, as the fracture 432 further propagates through the subsurface formation 406 and into the upper zone 430, the fracture 432 becomes poroelastically coupled to a transducer fracture 452 of the upper interval 462 of the monitor well 422 and a corresponding pressure increase is measured by the upper pressure gauge 428. Accordingly, an operator is able to determine when the fracture 432 transitions between the lower zone 424 and the upper zone 430 of the subsurface formation 406.

In certain implementations, the monitor well 422 may be a previously active well that has been repurposed. In such implementations, the transducer fractures 450, 452 may be fractures that were previously formed during initial completion of the previously active well. Accordingly, isolating intervals of the monitor well 422 may include the steps of, among other things, identifying the location of existing fractures (e.g., by seismic or similar analysis) extending from the monitor well 422, determining which fractures extend into zones-of-interest of the subterranean formation, and identifying depths within the monitor well 422 in which isolation devices may be installed to define the intervals for monitoring propagation of fractures within each of the zones-of-interest.

In other implementations, targeted placement of the transducer fractures may be used to locate the transducer fractures within specific zones of the subterranean formation. For example, based on seismic or similar geological data, zones of the subterranean formation and their corresponding depths may be identified. Fracturing operations may then be applied within one or more intervals of the monitor well corresponding to the zones-of-interest to create transducer fractures extending from the intervals into the subterranean formation. In conjunction with such fracturing operations, the intervals may also be isolated, such as by installing isolation devices within the monitor well between the intervals.

Identifying a transition between zones may be used to control a fracturing operation in various ways. For example, if extension of the fracture 432 into the upper zone 430 is desired but no pressure increase within the upper interval 462 is measured by the upper pressure gauge 428, the fracturing operation may be adjusted to increase propagation of the fracture 432. Such adjustments may include, without limitation, one or more of increasing the viscosity of the fracturing fluid, increasing the size of proppants added to the fracturing fluid, modifying the amount or type of additives introduced into the fracturing fluid, increasing the injection rate of the fracturing fluid, or applying any other of a number of modifications to the fracturing operation directed to increasing fracture propagation.

Conversely, if propagation of the fracture 432 into the second interval 430 is not desired or is to be otherwise limited to the lower zone 424, an increase in pressure measured by the upper pressure gauge 428 may be used to identify when undesirable fracture growth into the upper zone 430 has occurred. In response, the fracturing operation may be modified to reduce further propagation of the fracture 432. Such modifications may include, without limitation, decreasing the viscosity of the fracturing fluid, decreasing proppant size, adding a diverting agent into the fracturing fluid or otherwise performing a diversion operation, reducing the injection rate of the fracturing fluid, initiating a rate cycling operation, or applying any other of a number of modifications to the fracturing operation directed to reducing propagation of the dominant fracture.

Although FIG. 4 includes only a lower pressure gauge 426 and an upper pressure gauge 428, any number of pressure gauges or sensors may be disposed within the monitor well 422 in order to measure pressure within different isolated intervals of the monitor well 422. Moreover, although the monitor well 422 is illustrated in FIG. 4 as being substantially vertical and that the first zone 424 and the second zone 430 of the subsurface formation 406 are similarly illustrated as being vertically arranged layers, other arrangements of the gauges, intervals, and zones are also contemplated. For example, one or more pressure gauges may be disposed within a horizontal or other directional section of the monitor well 422. Accordingly, although the monitor well 422 includes each of a lower pressure gauge 426 and an upper pressure gauge 428, the terms "upper" and "lower" are not intended to limit implementations according to the present disclosure to the vertical monitor well configuration illustrated in FIG. 4. Rather, "upper" and "lower" are merely intended to convey that the pressure gauges 426, 428 are disposed within different intervals of the monitor well 422.

Figure 5:
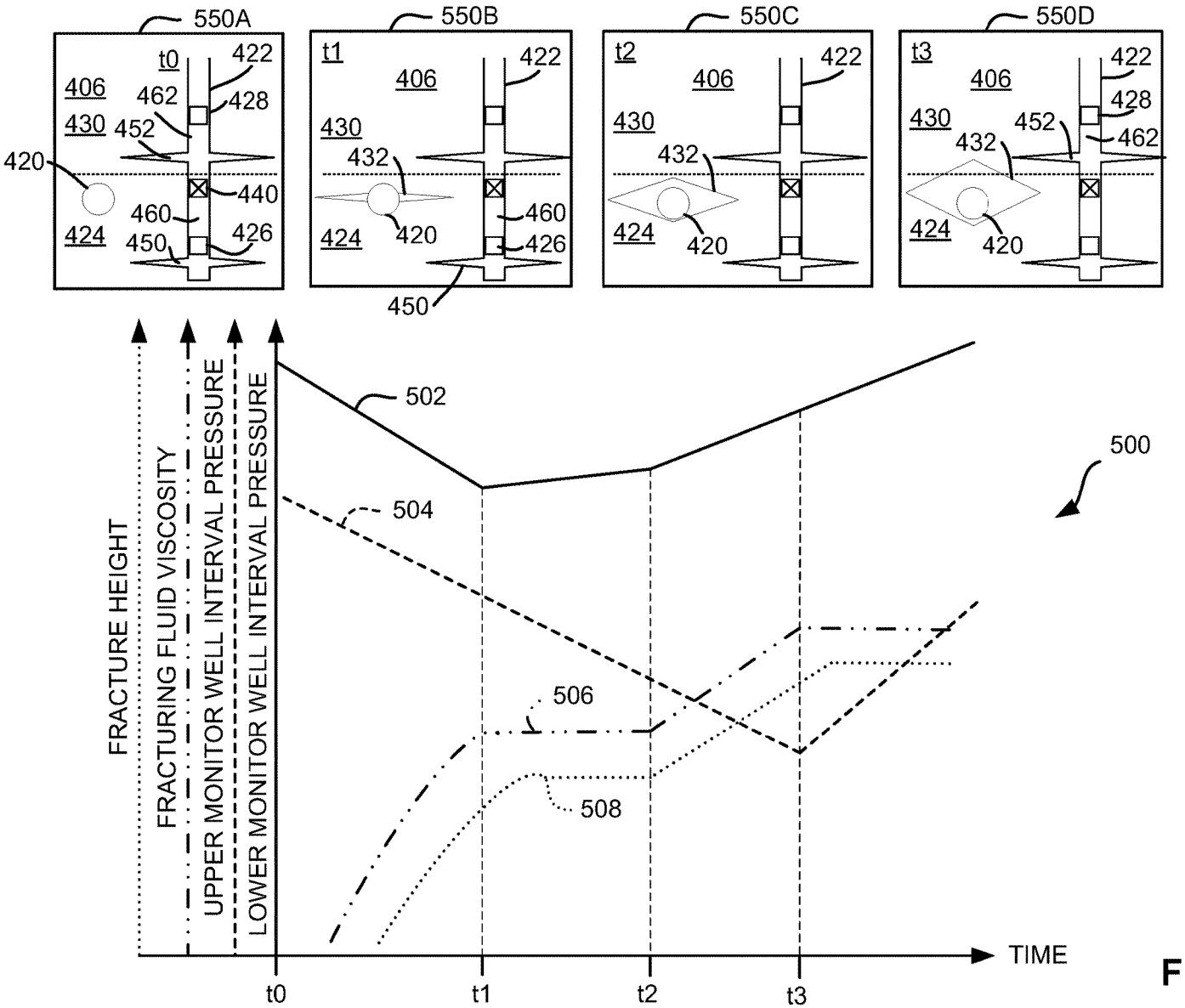
FIG. 5 is a second example graph illustrating a fracturing operation conducted in the well environment of FIG. 4.

FIG. 5 is an example graph 500 illustrating various parameters and measurements corresponding to a fracturing operation over time. For explanatory purposes, the following description of FIG. 5 references items and components of the well completion environment 400 of FIG. 4. Illustrations 550A-D provide schematic illustrations of the subterranean formation 406 during the fracturing operation illustrated by the graph 500. The graph 500 includes a first pressure line 502 (shown as a solid line) corresponding to pressure readings obtained from a lower pressure gauge 426 of a monitor well 422 (each identified in illustration 550A) and a second pressure line 504 (shown as a dashed line) corresponding to pressure readings obtained from an upper pressure gauge 428 (also identified in illustration 550A) of the monitor well 422.

As shown in illustration 550A, the monitor well 422 is divided by an isolation device 440 into a lower interval 460 and an upper interval 462 within which pressure measurements are obtained by the lower pressure gauge 426 and the upper pressure gauge 428, respectively. The lower interval 460 includes a lower transducer fracture 450 that extends into a lower zone 424 of the subterranean formation 406. Similarly, the upper interval 462 includes an upper transducer fracture 452 that extends into an upper zone 430 of the subterranean formation 406.

The graph 500 further indicates each of a fracturing fluid viscosity 506 and a fracture height 508. Although various fracturing operation parameters may be controlled in order to modify fracture propagation, the example illustrated in the graph 500 is directed to an implementation in which fracturing fluid viscosity is the primary parameter by which fracture propagation is controlled. In other implementations according to the present disclosure, fracture propagation may be controlled by modifying one or more other operational parameters in addition to or instead of fracturing fluid viscosity. Examples of such parameters are discussed in more detail below in the context of FIGS. 6-9, as well as previously relative to rate cycling.

Referring now to the fracturing operation illustrated by the graph 500 in more detail, at time t0, a fracturing fluid is injected into the active well 422 but a poroelastic response is not observed by either of the lower pressure gauge 426 or the upper pressure sensor 428. Accordingly, each of the first pressure line 502 and the second pressure line 504 indicate a substantially constant decrease of pressure (i.e., leak off) within each of the intervals 460, 462. As shown in illustration 550A, such a response by the lower pressure gauge 426 and the upper pressure gauge 428 may be the result of a fracture not being formed or otherwise not extending sufficiently into either of the lower zone 424 of upper zone 430 of the subterranean formation 406, respectively.

To induce fracturing from the active well 420, the viscosity of the fracturing fluid is increased as illustrated by an upward trend in the fracturing fluid viscosity line 506 between time t0 and time t1. A corresponding increase in the fracture height is similarly observed during this time period, indicating growth of a fracture 432 from the active well 420. At time t1, the slope of the first pressure line 502 becomes positive, indicating poroelastic coupling between the fracture 432 and the lower transducer fracture 450. More specifically, poroelastic coupling between the fracture 432 and the lower transducer fracture 450 results in an increase of pressure within the lower interval 460 of the monitor well 422 as measured by the lower pressure gauge 426. Notably, the second pressure line 504 does not exhibit a similar change, indicating that a similar pressure increase is not being observed within the upper interval 462 of the monitor well 422. Accordingly, it can be concluded that although fracture growth has occurred, such growth is limited to within the lower zone 424 of the subsurface formation 406 and does not extend into the upper zone 430 of the subsurface formation 406.

In response to the fractures failing to extend into the upper zone 430, the viscosity of the fracturing fluid is further increased between times t2 and t3 to encourage further propagation of the fracture 432 from the active well 420. At time t3, a pressure increase is detected by the upper pressure gauge 428, indicating poroelastic coupling between the fracture 432 and the upper transducer fracture 452 of the monitor well 422. In other words, increasing the viscosity of the fracturing fluid resulted in sufficient fracture propagation such that the fracture 432 extended into the upper zone 430 of the subsurface formation 406. As the fracture 432 entered into the upper zone 430, the fracture 432 became poroelastically coupled to the upper transducer fracture 452 such that a pressure response was measured by the upper pressure gauge 428 within the upper interval 462 of the monitor well 422.

In summary, the example of FIG. 5 illustrates one implementation of the present disclosure in which multiple pressure gauges are disposed in isolated intervals within the monitor well 422 and each pressure gauge measures pressure within its respective interval. The responses observed form each pressure gauge may be used to track fracture propagation through a subterranean formation 406. The process generally includes performing a first fracturing operation using a first set of fracturing operation parameters. By observing and comparing pressure responses from the pressure gauges, one or more parameters of the fracturing operation may be modified to alter propagation of the fractures through the subterranean formation 406. In the example of FIG. 5 specifically, the modification included increasing the viscosity of the fracturing fluid in order to increase propagation. Subsequent readings obtained from the pressure gauges may then be used to confirm whether the desired effects of the modification have occurred. To the extent the desired effects have not occurred, the parameters of the fracturing operation may be further modified and the resulting pressures measured and analyzed accordingly.

Figure 6:
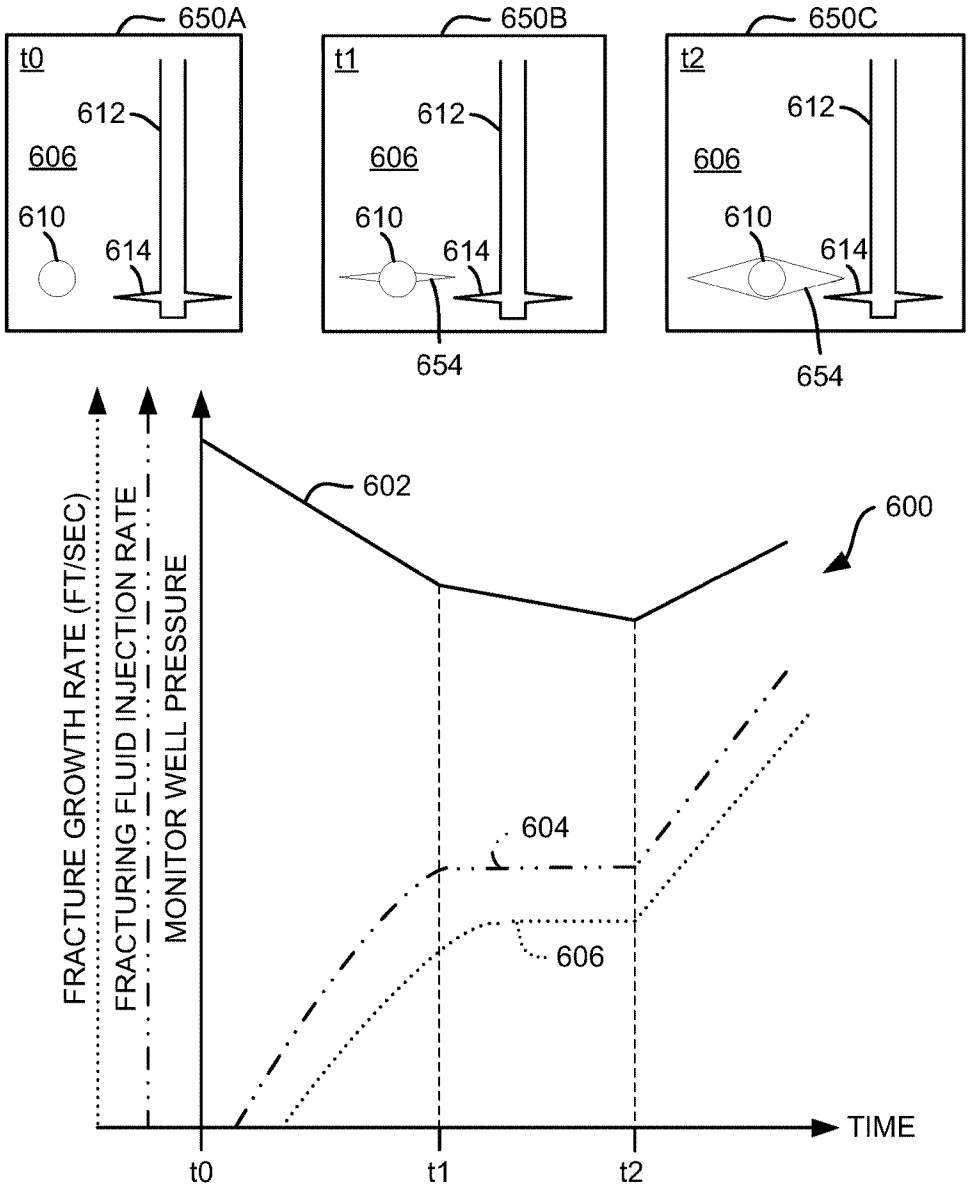
FIG. 6 is a third example graph illustrating a fracturing operation in which fracturing injection rate is modified in response to monitor well pressure.

FIG. 6 is an example graph 600 illustrating another fracturing operation in accordance with this disclosure. Further reference is made to schematic illustrations 650A-C, which depict a subterranean formation 606 at various stages of a fracturing operation conducted on an active well 610. The graph 600 includes a pressure line 602 corresponding to a pressure measurement obtained from a monitor well 612. As shown in illustrations 650A-C, the monitor well 612 may include one or more transducer fractures 614 extending into the subterranean formation 606. The graph 600 further includes an injection rate line 604 (shown as a dashed and dotted line) and a fracture growth rate line 606 (shown as a dotted line). Similar to the example fracturing operation illustrated in FIGS. 2A and 2B, the fracturing operation of FIG. 6 illustrates how a fracturing fluid injection rate may be modified to control fracture propagation during a fracturing operation.

At time t0, no fracturing fluid has been injected into active well 610 and, as a result, no fractures have started propagating from the active well 610. From time t0 to time t1, the fracturing fluid injection rate is increased, resulting in a corresponding increase in fracture growth rate. At time t1, initial poroelastic coupling occurs between a dominant fracture 614 of the active well 610 and the monitor well 612.

As illustrated by the interval between time t0 to t1, the poroelastic coupling results in a decreased rate of pressure loss (i.e., a decreased leak off rate) within the monitor well 612. To further propagate the fracture 614 and increase the poroelastic coupling between the active well 610 and the monitor well 612, the fracturing fluid injection rate is increased at time t2. The resulting propagation of the dominant fracture 614 is then observed as a positive rate of pressure change from time t2 onward.

Figure 7:
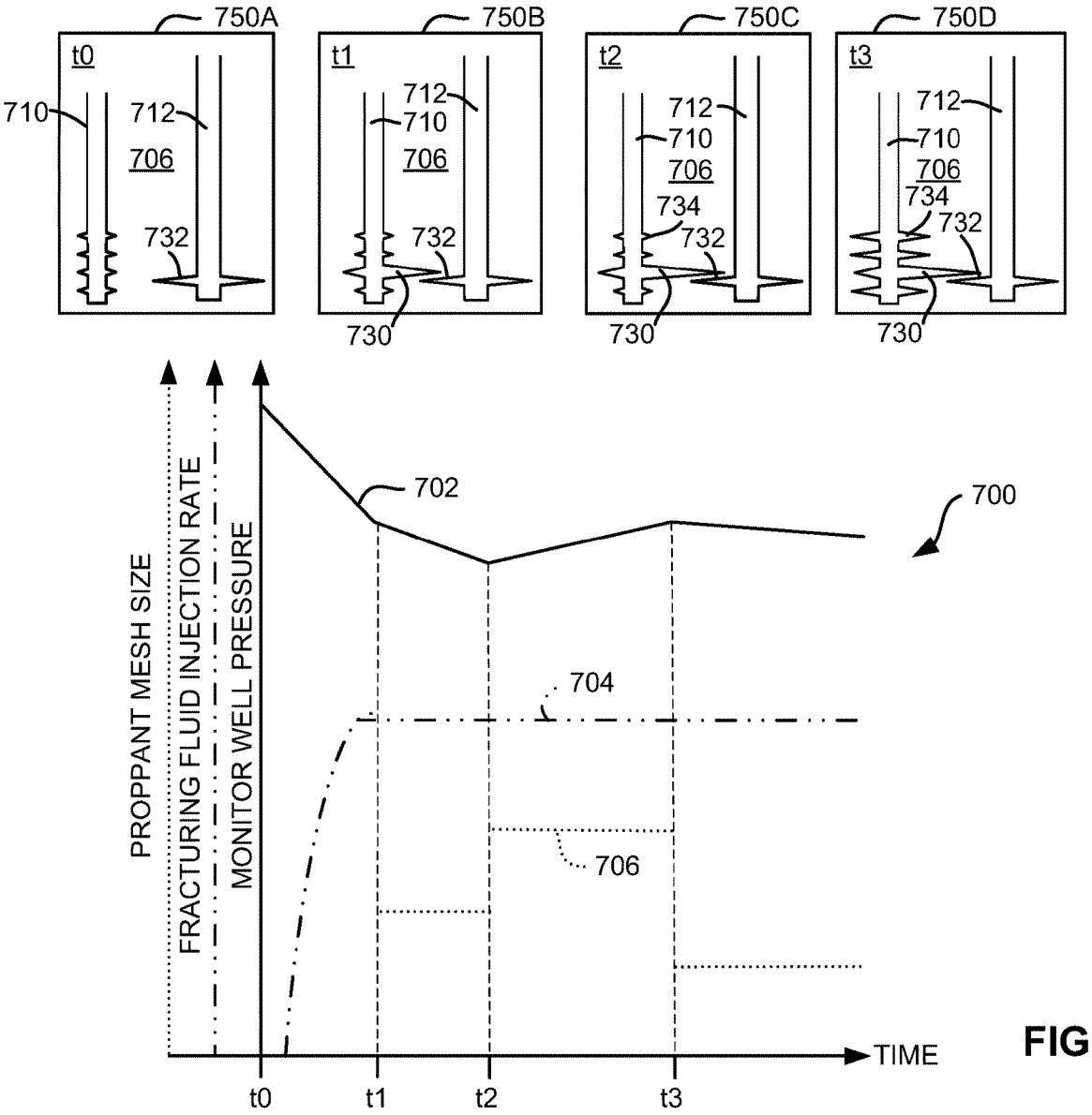
FIG. 7 a fourth example graph illustrating a fracturing operation in which fracturing injection rate and proppant size are modified in response to monitor well pressure.

FIG. 7 is another example graph 700 illustrating a fracturing operation. Further reference is made to schematic illustrations 750A-D, which depict a subterranean formation 706 at various stages of a fracturing operation conducted on an active well 710. The graph 700 includes a pressure line 702 corresponding to a pressure measurement obtained from a monitor well 712. As shown in illustrations 750A-D, the monitor well may include one or more transducer fractures 714 extending into the subterranean formation 706. The graph 700 further includes an injection rate line 704 (shown as a dashed and dotted line) and a proppant mesh size line 706 (shown as a dotted line).

At time t0, no fracturing fluid has been provided into active well 710 and, as a result, fractures have not started propagating from the active well 710. From time t0 to time t1, the fracturing fluid injection rate is increased and subsequently held constant. At time t1, a first proppant having a first size is introduced into the active well 710 with the fracturing fluid. As indicated by the pressure line 702 during the interval between time t1 and t2, injection of the fracturing fluid with the proppant of the first size results in propagation of a dominant fracture 730 and subsequent poroelastic coupling between the dominant fracture 730 and a transducer fracture 732 of the monitor well 712. Such poroelastic coupling is indicated by the rate of pressure change within the monitor well 712 becoming less negative (i.e., the rate at which pressure is lost from the monitor well 712 is reduced).

Between times t2 and t3, the original mesh is changed to a second, larger mesh while the fracturing fluid injection rate is held constant. By using a larger mesh, the size of proppant particles in the fracturing fluid is increased. In response to increasing the proppant size, the rate of pressure change within the monitor well 712 is further increased, generally indicating that further propagation of the dominant fracture 730 has occurred. Such redirection may occur, for example, if the larger proppant size results in non-dominant fractures, such as non-dominant fracture 734, being blocked or "screened out" by the larger proppant particles. In such instances, fracturing fluid could be restricted or otherwise unable to enter the non-dominant fractures, thereby reducing their propagation while also being redirected to the dominant fracture 730, thereby increasing its propagation.

In response to the rate of pressure change increase observed between times t2 and t3, the mesh size is changed again to a third, smaller mesh resulting in a decrease in proppant particle size. For purposes of this example, the fracturing fluid injection rate is maintained at a constant rate. In response to reducing the proppant size, the rate of pressure change as measured within the monitor well 712 decreases, implying that an increased proportion of the fracturing fluid is being direct to the non-dominant fractures, such as non-dominant fracture 734, resulting in their propagation.

Figure 8:
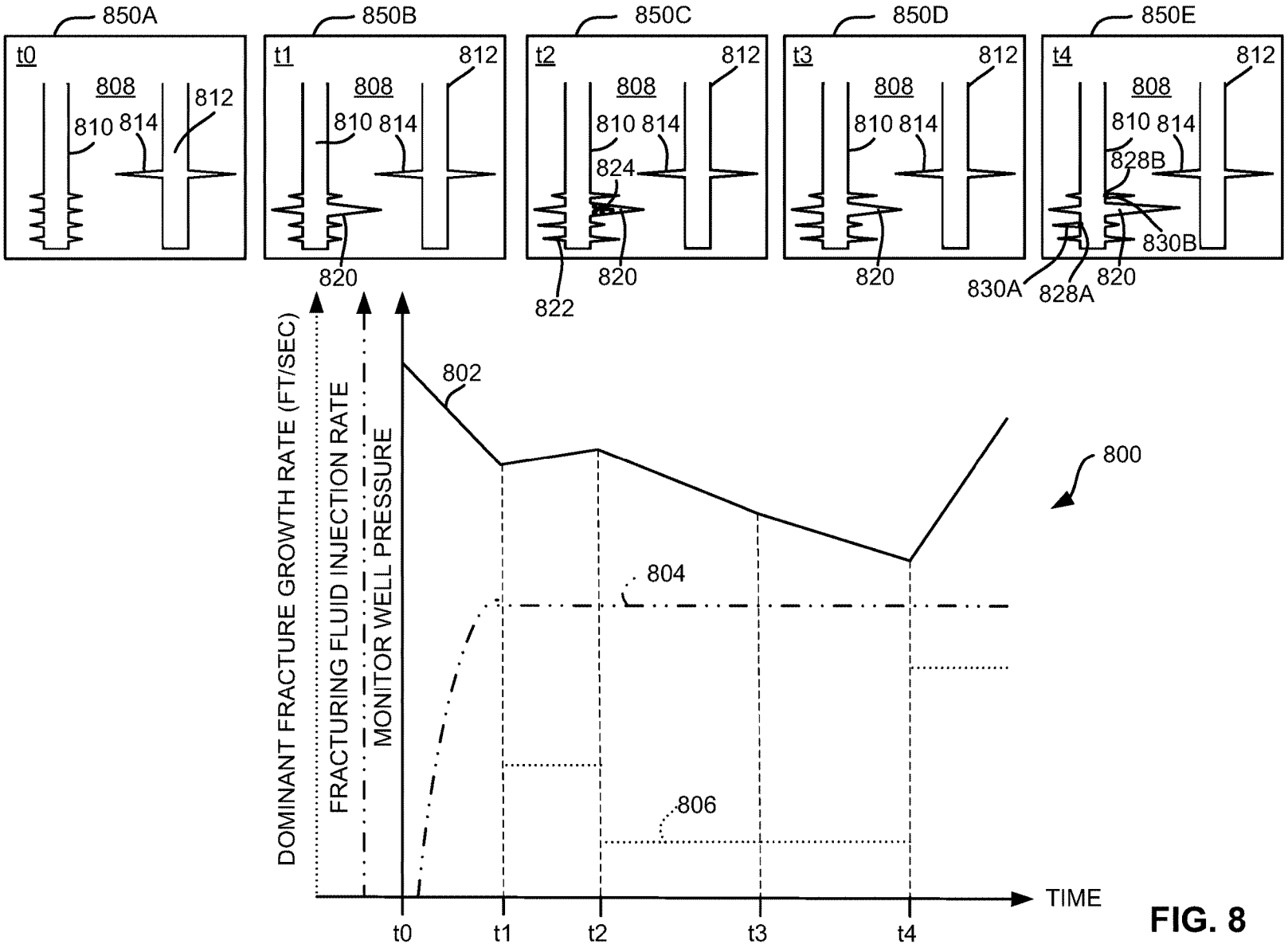
FIG. 8 a fourth example graph illustrating a fracturing operation in which diversion operations are undertaken in response to monitor well pressure.

FIG. 8 is another example graph 800 illustrating application of a diversion operation during a broader fracturing operation. In an example diversion operation a chemical, such as an acid or resin and generally referred to as a diverting agent, may be injected into a well to restrict or block flow of a treatment fluid into pathways extending through a subterranean formation. As a result of the diverting agent, treatment fluids that are subsequently injected into the well are diverted to other, less restricted pathways within the subterranean formation, thereby improving distribution of the treatment fluid. The diverting agent may be subsequently dissolved or otherwise removed to restore flow through the previously obstructed pathways. In the context of fracturing operations, for example, diversion may be used to improve the distribution of fractures within an interval by temporarily blocking dominant fractures and then injecting a fracturing fluid to propagate non-dominant fractures. The diverting agent may then be removed in order to allow further propagation of the dominant fracture albeit with a move even distribution between the dominant and non-dominant fractures.

FIG. 8 illustrates an example fracturing operation in which the pressure (or pressure-related property, such as a rate of pressure change) within a monitor well 812 is used to determine the effectiveness of a diversion operation. One or more parameters of the fracturing operation are modified in accordance with the feedback from the monitor well 812. Further reference is made to schematic illustrations 850A-E, which depict a subterranean formation 808 through which the monitor well 812 and the active well 810 extend at various stages of the fracturing operation. The graph 800 includes each of monitor well pressure 802 (solid line), fracturing fluid injection rate 804 (dashed and dotted line), and dominant fracture growth rate 806 (dotted line) over time. As shown in illustrations 850A-E, the monitor well 812 may include one or more transducer fractures, such as transducer fracture 814, extending into the subterranean formation 808.

In certain implementations of the present disclosure, such poroelastic coupling may be used to determine when a diverting agent should be introduced to stop or slow further propagation of the dominant fracture 820. For example, a pressure increase within the monitor well 812 may be observed before anticipated. In such circumstances, the pressure increase within the monitor well 812 may indicate a higher proportion of fracturing fluid had been directed into only certain fractures, such as the dominant fracture 820, thereby causing increased propagation of those certain fractures and underdevelopment of other fractures within the subsurface formation 808. In response, a diversion operation may be initiated. Such a diversion operation may include, among other things, one or more of adding a diverting agent to the fracturing fluid, modifying the ratios of other additives to the fracturing fluid, changing the fracturing fluid injection rate, or altering any other parameter of the fracturing operation.

The rate of pressure change in the monitor well 812 may also be used to determine the effectiveness of a previously performed diversion operation. For example, if the rate of pressure change in the monitor well 812 decreases after a diversion operation, it may be an indication that the diversion operation was successful and that a larger proportion of the fracturing fluid is being diverted to other fractures. Alternatively, if the rate of pressure change in the monitor well 812 remains constant or increases after a diversion operation, it may be an indication that the diversion operation was unsuccessful. Such circumstances may be the result of, among other things, insufficient diverting agent injected into the monitor well 812 or other non-dominant fractures becoming blocked or obstructed by the diversion operation. In response to observing a constant or increased rate of pressure change within the monitor well 812, parameters of the fracturing operation may be modified. For example, a second diversion operation which may include first introducing a dissolving agent into the well to remove the previously injected diverting agent.

In the example of FIG. 8, the graph 800 illustrates responses to each of a successful and unsuccessful diversion operation conducted on the active well 810. Referring back to the graph 800, between time t0 and t1, fracturing fluid is injected into the active well 810, resulting in the propagation of a dominant fracture 820 from the active well 810. At time t1, the dominant fracture 820 sufficiently propagates to result in poroelastic coupling between the dominant fracture 820 and the transducer fracture 814. Such poroelastic coupling may be observed, for example, as an increase of pressure within the monitor well 812. As shown in the graph 800, the increase of pressure within the monitor well 812 generally coincides with an increase in the rate of growth of the dominant fracture 820.

In response to detecting a pressure increase in the monitor well 812, a diversion operation may be initiated in which a diverting agent is injected into the active well 810 to block or at least partially obstruct the dominant fracture 820. The time period between t2 and t3 illustrates the effect of a successful diversion operation. Specifically, as shown in illustration 850C, the diverting agent 824 introduced at time t2 reduces the amount of fracturing fluid entering the dominant fracture 820, which is indicated as a reduction in the rate of fracture growth 806 and a negative rate of pressure change within the monitor well 812. The fracturing fluid is instead diverted to other non-dominant fractures, such as fracture 822, causing their propagation instead. At t3 and as shown in illustration 850D, the diverting agent 824 (shown in illustration 850C) may then be removed, such as by introducing a dissolving agent.

For illustrative purposes, at time t4, a second diversion operation is initiated. As shown in illustration 850E, this second operation is unsuccessful in that diverting agent 828A, 828B blocks or otherwise obstructs non-dominant fractures 830A, 830B. Such an unsuccessful diversion operation may result in increased fracturing fluid being directed into the dominant fracture 820, thereby increasing the growth rate of the dominant fracture 820 and corresponding poroelastic coupling between the dominant fracture 820 and the monitor well 812. As a result, the rate of pressure change within the monitor well 812 may increase.

Various parameters of the fracturing operation may be modified in response to identifying an unsuccessful diversion operation. For example, in certain implementations, a dissolving agent may be introduced to remove the previously injected diverting agent and a subsequent diversion operation may be initiated. Parameters of the subsequent diversion operation may also be modified in light of the previous unsuccessful diversion attempt. For example, one or more of the diverting agent type or ratio may be modified as compared to the unsuccessful diversion operation. Other parameters, including, without limitation, the fracturing fluid injection rate, fracturing fluid viscosity, and ratio of other additives may also be modified in the subsequent diversion operation or any phase of a fracturing operation following either a successful or unsuccessful diversion operation.

Systems according to the present disclosure may also be used to identify if and when direct fluid communication occurs between an active well and an offset well, such as a monitoring well. Such communication between an active well and an offset well (such as a monitor well) is sometimes referred to as a "frac hit" and can lead to, among other things, damage to the offset well, reduced fracturing efficiency of the active well, and other costly and time-consuming issues. Although frac hits are ideally avoided by careful monitoring of fracturing operations, should a frac hit occur, rapid response and remediation can enable operators to reduce further damage to the offset well and minimize fracturing operation downtime.

Figure 9:
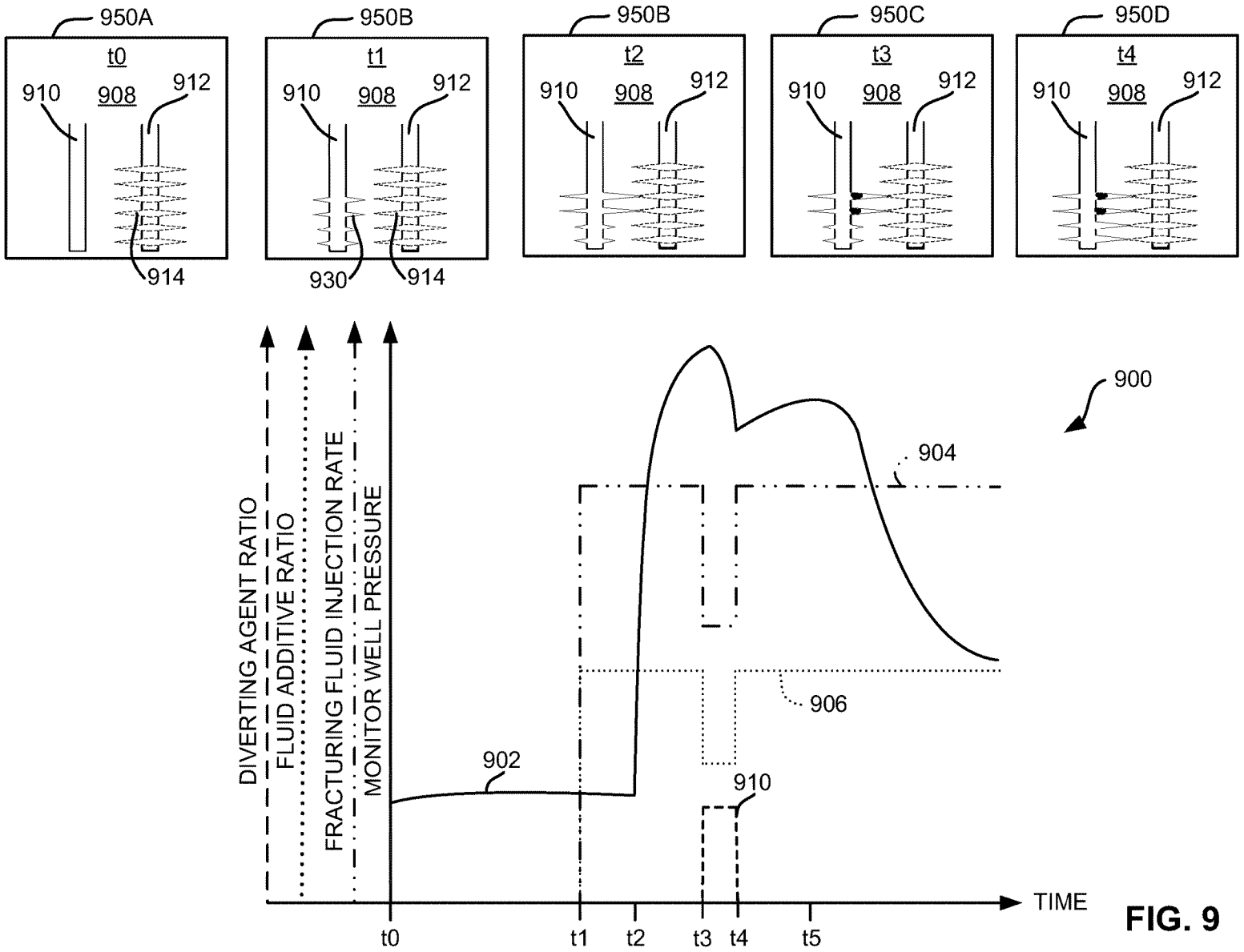
FIG. 9 a fifth example graph illustrating a fracturing operation in which operation parameters are modified in response to direct fluid communication between an active well and a monitor well.

FIG. 9 is a graph 900 illustrating a fracturing operation in which direction fluid communication occurs between an active well 910 and a monitor well 912. Further reference is made to schematic illustrations 950A-E, which depict a subterranean formation 908 through which the monitor well 912 and the active well 910 extend at various stages of the fracturing operation. The graph 900 illustrates each of monitor well pressure 902 (solid line), a fracturing fluid injection rate 904 (dashed and dotted line), a fluid additive ratio 906 (dotted line), and a diverting agent ratio 910 (dashed line). As shown in illustrations 950A-E, the monitor well 912 may include one or more preexisting fractures, such as fracture 914, extending into the subterranean formation 908.

During the period between time t0 and t1, little or no fracturing fluid is injected into the active well 910. Accordingly, no significant change occurs to the pressure within the monitor well 912. At time t1, injection of the fracturing fluid (which includes an additive) is initiated, resulting in the propagation of fractures, such as fracture 930, from the active well 910. A sharp increase in pressure within the monitor well 912 is observed beginning at time t2, indicating fluid communication between one or more fractures extending from the active well 910 and a fracture of the monitor well 912. Such a pressure response may also occur in response to establishing fluid communication between fractures of the active well 910 and the primary wellbore of the monitor well 912.

At time t3, various actions are initiated in response to the direct fluid communication between the active well 910 and the monitor well 912. Specifically, each of the fracturing fluid injection rate and the additive ratio are reduced and a diverting agent is introduced into the active well 910. As illustrated in the graph, the reduction of the fracturing fluid injection rate may result in an initial drop in pressure within the monitor well 912.

At time t4, after diverting agent has been introduced into the active well 910 and given an opportunity to block flow between the active well 910 and the monitor well 912, the fracturing operation is continued by increasing the fracturing fluid injection rate and the additive ratio. In certain implementations, such an increase may be to pre-diversion levels, however, a reduced fracturing injection rate or reduced additive ratio as compared to pre-diversion levels may also be applied to reduce the likelihood of undoing the diversion operation or causing further direct fluid communication between the active well 910 and the monitor well 912. As shown in the time period between times t4 and t5, increasing the fracturing fluid injection rate results in the pressure within the monitor well 912 increasing, peaking at time t5, then reducing and levelling off, indicating a successful diversion operation.

The foregoing examples of fracturing operations generally involved fracturing a single stage of an active well, measuring a corresponding response in a monitor well, and then adjusting the fracturing operation to continue fracturing the current stage. Although systems and methods according to the present disclosure are well-suited for such single stage applications, data obtained from the monitoring well during fracturing of one stage may also be used to modify or dictate parameters for fracturing operations for subsequent stages. In certain implementations, one of more characteristics of the pressure data obtained from the monitoring well during fracturing of a first stage may be used to dictate, among other things, a fracturing fluid injection rate, an additive ratio, a viscosity, a proppant size, or other fracturing operation parameter of a subsequent stage. For example, systems in accordance with this disclosure may monitor pressure within the monitor well to determine whether a value corresponding to the pressure exceeds one or more thresholds. In response to the value exceeding a threshold, the system may automatically modify parameters of subsequent stages. In other implementations, the pressure data of the monitor well may be used in conjunction with other data including, without limitation, data collected from other sensors during the same or prior fracturing operations, seismic data for the subterranean being fractured, historical well data, production data, and the like. Such data may be collected and analyzed to determine fracturing operation parameters using various techniques including, without limitation, data mining, statistical analysis, and machine learning and other artificial intelligence-based techniques implemented as one or more algorithms that receive the various collected data and provide parameter values for fracturing operations.

FIG. 10 is a table 1000 illustrating a portion of an example fracturing operation plan and, more specifically, a fracturing operation plan that includes automated rate cycling and subsequent monitoring of the success of the automated rate cycling. As shown, the table 1000 includes entries for each of stages 47 and 48 of the fracturing operation.

In general, the fracturing operation plan includes instructions and operational parameters for conducting one or more fracturing operations, each of which may include multiple stages. For example, the instructions may include, among other things, activating, deactivating, or modifying the performance of one or more pieces of equipment for carrying out the fracturing operation and/or changes to parameters governing operation of such equipment. The fracturing operation may further include thresholds, limits, and other logical tests. Such tests may be used, for example, to generate alerts or alarms, to initiate control or other routines, to select subsequent operational steps, or to modify current or subsequent steps in the fracturing operation. In implementations of the present disclosure, the fracturing operation plan may be executed, at least in part, by a computing system and the fracturing operation plan may be stored within memory accessible by the computing system. For example, in certain implementations the fracturing operation plan may include computer-executable instructions that may be executed by the computing system in order to control at least a portion of a fracturing operation. Executing the fracturing operation plan may then cause the computing system to, among other things, issue commands to equipment in accordance with the fracturing operation plan, receive and analyze data related to steps in the fracturing operation plan, and update or otherwise modify parameters of the fracturing operation plan in accordance with the received data.

The fracturing operation plan may also include instructions for operations that require manual intervention by an operator. For example, in some implementations, executing a fracturing operation in accordance with the fracturing operation plan may require an operator to provide confirmation or acknowledgement prior to a computing system executing one or more steps of the fracturing operation plan. In other implementations, more direct intervention by the operator may be required. For example, the operator may be required to manually activate, deactivate, or modify performance parameters of equipment.

Referring now to the example fracturing operation illustrated by the table 1000, an initial trigger 1002 is provided for each stage of the fracturing operation. The trigger 1002 is generally a condition that, when met, initiates a rate cycle operation, as indicated in the "Action" column 1004. For example, in stage 47, the trigger to initiate rate cycling is an increase of 5 psi within the monitor well following initiation of the first ramp. The first ramp generally corresponds to the first injection of fracturing fluid and initiation of propagation for the stage. Similarly, in stage 47, the rate cycling trigger is an increase of 20 psi following the first ramp. Notably, the trigger of either of stages 47 and 48 may be dynamically determined, at least in part, by pressure responses observed in the monitor well during fracturing of one or prior stages.

In response to the trigger, rate cycling is initiated by reducing the fracturing fluid injection rate for a predetermined amount of time. For stages 47 and 48, such rate cycling includes reducing the injection rate of fracturing fluid to 0 bpm for three minutes. Following a rate cycle, each stage may also include a test to determine the effect of the rate cycling. As noted in table 1000, the test 1006 for each of stages 47 and 48 is an observed rate of pressure change decrease of more than 20%. If such a decrease in the rate of pressure change is observed, the fracturing operation proceeds according to the base schedule per column 1008. If, however, no such pressure rate decrease is observed within a predetermined time (e.g., five minutes), a subsequent rate cycle may be initiated or other adjustments to the fracturing operation parameters may be applied, as shown in column 1010. For example, as indicated for each of stages 47 and 48, the fracturing fluid is changed to a linear gel fracturing fluid.

Figure 11:
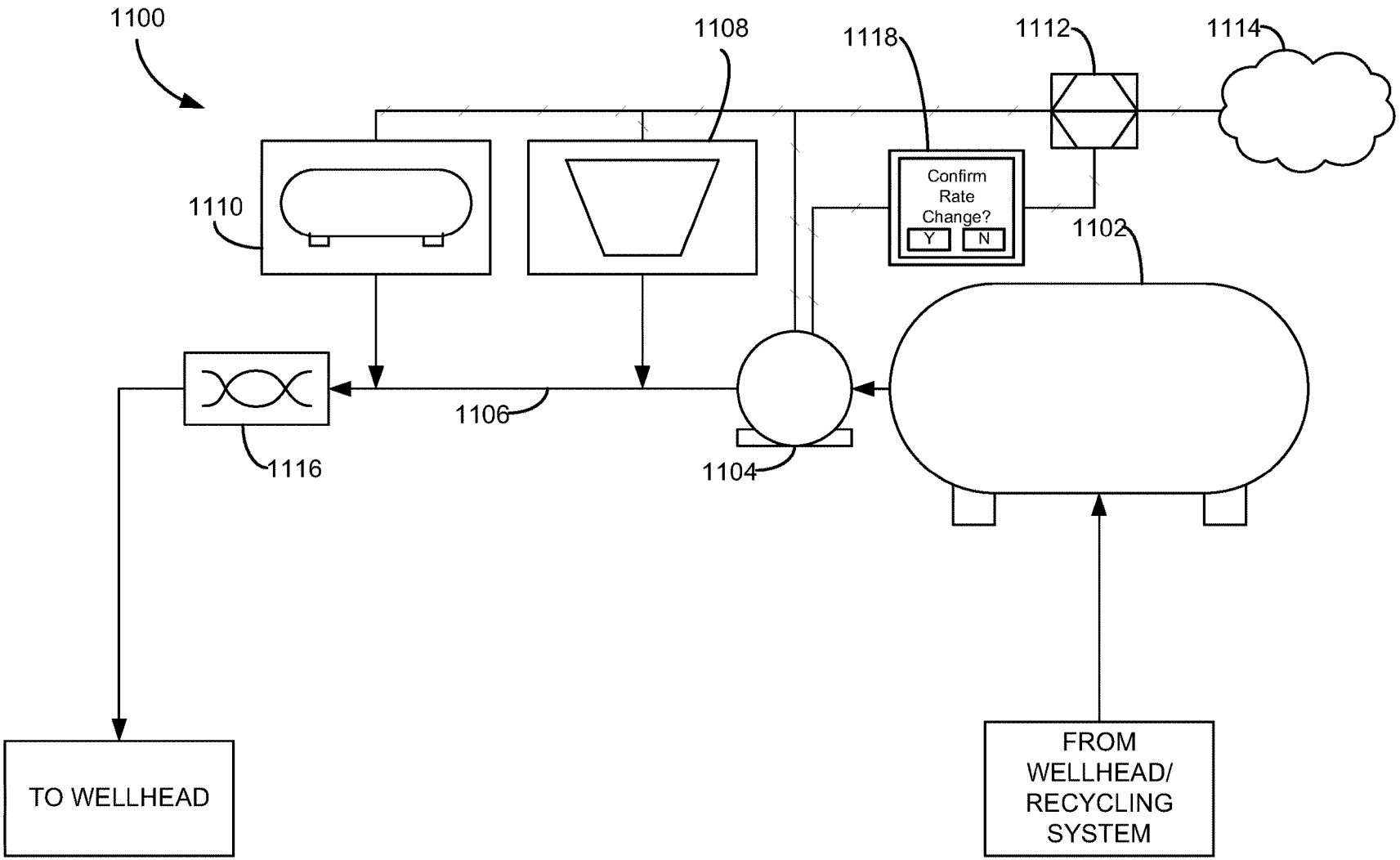
FIG. 11 is a schematic illustration of a pumping system for use in systems according to the present disclosure.

FIG. 11 is a schematic illustration of a pumping system 1100 for use in systems according to the present disclosure. Pumping system 1100 includes a primary fluid storage 1102 coupled to a pump 1104 configured to pump fluid from primary fluid storage 1102 along an outlet 1106 to a wellhead of an active well to facilitate fracturing of the active well. A proppant system 1108, an additive system 1110, and a blender 1116 are further coupled to an outlet line 1106. Each of the proppant system 1108, the additive system 1110, and the pump 1104 are further communicatively coupled to a computing device 1112. In certain implementations, computing device 1112 is also communicatively coupled, either directly or indirectly, to a display of a control panel, human machine interface, or similar computing device.

During operation, the computing device 1112 transmits control signals to the pump 1104 to control pumping of fluid from the primary fluid storage 1102 by the pump 1104. As fluid is pumped from the fluid storage 1102 to the active well through the outlet 1106, proppants and other additives may be introduced into the fluid by the proppant system 1108 and the additive system 1110, respectively. In the pumping system 1100, each of the proppant system 1108 and the additive system 1110 are each communicatively coupled to and controllable, at least in part, by the computing device 1112. Accordingly, the computing device 1112 can control the amount of proppant and additive introduced into the fluid. The outlet 1106 may further include a blender 1116 or similar mixing device configured to mix the fluid from the primary fluid storage 1102 with proppants introduced by the proppant system 1108 and/or additives introduced by the additive system 1110.

The pumping system 1100 may also operate, at least in part, based on control signals received from a user. For example, the pumping system 1100 includes a display 1118 or similar device for providing system data, alerts, prompts, and other information to a user and for receiving input from the user. As shown in FIG. 11, the display 1118 may be used to prompt a user to confirm initiation of a change to the flow rate of fracturing fluid provided by the pumping system 1100. In alternative implementations, the display 1118 may further allow the user to receive other prompts and to issue other commands, such as those corresponding to operation of the proppant system 1108, the additive system 1110, or other components of the pumping system 1100.

In certain implementations, the primary fluid storage 1102 is coupled to the wellhead to permit recycling of fluid during a fracturing operation. Return fluid from the wellhead may require filtering or other processing prior to reuse and, as a result, the pumping system 1100 may further include or be coupled to equipment configured to treat return fluid. Such equipment may include, without limitation, settling tanks or ponds, separators, filtration systems, and reverse osmosis systems.

As illustrated in FIG. 11, the computing device 1112 is communicatively coupled to a network 1114 and is configured to receive data over the network 1114. For example, in certain implementations the computing device 1112 receives pressure measurements taken from a monitor well, such as the monitor well 122 shown in FIG. 1, and/or control signals from a control system or other computing device, such as computing system 150 (shown in FIG. 1), derived from such pressure measurements. Computing device 1112 then controls the pump 1104, the proppant system 1108, the additive system 1110, and other components of the pump system 1100 based on the measurement data and/or control signals. In alternative implementations, one or more components of the pump system 1100 are manually controlled, at least in part, by an operator. For example, in certain implementations, the output of the pump 1104 is manually controlled by an operator who receives pressure measurement data from a second operator at the monitor well 122 or by reading a gauge or display configured to communicate pressure within the active well 122.

The foregoing implementations of the present disclosure have generally included an active well undergoing a fracturing operation and an offset or monitor well. During the fracturing operation, pressure changes within the monitor well resulting from poroelastic coupling between the active well and the monitor well are used to evaluate the fracturing operation and to modify the fracturing operation accordingly.

Although the present disclosure may be implemented using such two-well approaches, single-well approaches are also possible. For example, prior to undergoing a fracturing operation, a portion of the active well may be isolated and one or more pressure gauges or other pressure measurement devices may be installed to measure pressure within the isolated portion of the active well. The isolated portion of the active well may also include a transducer fracture extending into the surrounding formation. In such an arrangement, the isolated portion of the active wellbore may function similarly to the previously discussed monitor well for purposes of analyzing and controlling a fracturing operation of other portions of the active well. More specifically, as fractures are formed in another section of the active well during a fracturing operation, the new fractures can become poroelastically coupled to the transducer fracture of the isolated portion. This poroelastic coupling results in pressure effects within the isolated portion of the active well indicative of the growth of the new fracture (or fractures) and, more generally, the progress of the fracturing operation. As a result, the pressure within the isolated portion of the active well may be used to analyze and control the fracturing operation. This concept is discussed below in more detail with reference to FIG. 12.

Figure 12:
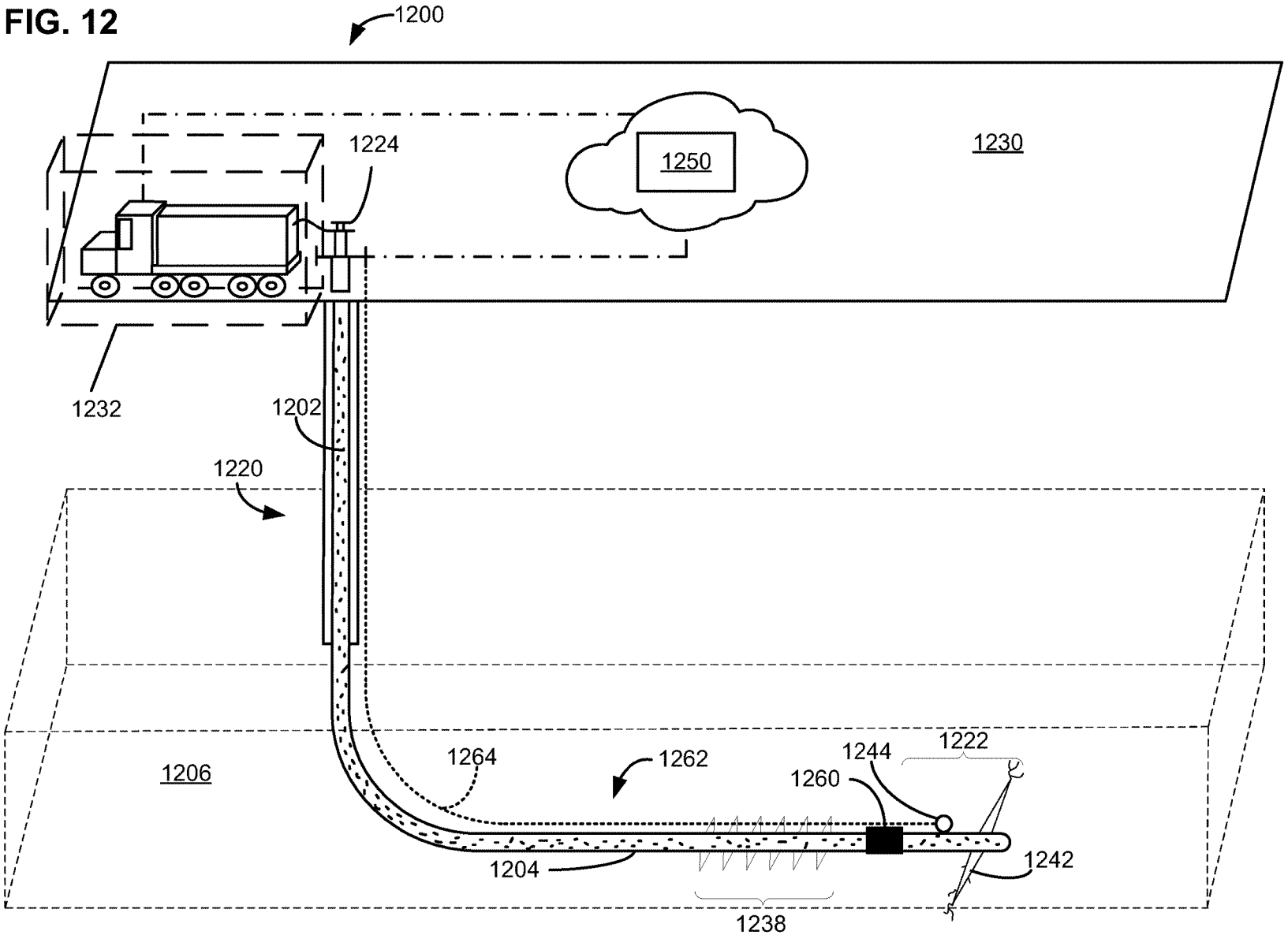
FIG. 12 is a schematic illustration of a second example well completion environment for completing a fracturing operation in accordance with the present disclosure.

FIG. 12 is a schematic diagram of an example well completion environment 1200 for completing a fracturing operation in accordance with the present disclosure. The well completion environment 1200 includes a subsurface formation 1206 through which a well 1220 extends. The well 1220 includes a vertical well section 1202 and a horizontal well section 1204. The horizontal active well section 1204 includes an isolated well section 1222 that is isolated from an uphole section 1262 of the well 1220. The isolated well section 1222 may be created, for example, by installing a bridge plug 1260, packer, or similar isolation device within the well 1220 between the uphole section 1262 and the portion of the well 1220 to be isolated. As illustrated in FIG. 12, the isolated well section 1222 may correspond to a toe of the well 1220. The isolated well section 1222 may include at least one transducer fracture 1242 extending into the subterranean formation 1206.

The well 1220 may include a wellhead 1224 disposed at a surface 1230 of the well completion environment 1200, the wellhead 1224 including sensors, gauges, and similar instrumentation for capturing data regarding the well completion environment 1200 and, in particular, fracturing operations conducted in the well 1220. The wellhead 1224 and other instrumentation of the well completion environment 1200 may generally be communicatively coupled to a computing system 1250 that receives signals and measurements from the instrumentation and controls various well-related operations. As shown in FIG. 12, one such instrument may be a pressure gauge 1244 (or similar pressure measurement device) disposed or otherwise adapted to measure pressure within the isolated well section 1222. In the illustrated example of FIG. 12, the pressure gauge 1244 is disposed downhole and coupled to the isolated well section 1222. The pressure gauge 1244 is also communicatively coupled to the wellhead 1224 by a tubing encapsulated cable 1264. Accordingly, pressure measurements corresponding to the pressure within the isolated well section 1222 may be obtained from the pressure gauge 1244 and communicated to the computing system 1250 via the wellhead 1224. The computing system 1250 may then control well-related operations (such as fracturing operations) based, at least in part, on the pressure measurements provided by the pressure gauge 1244.

The well completion environment 1200 is depicted after perforation but before fracturing of the uphole section 1262 of the well 1220. Accordingly, the horizontal section 1204 includes a plurality of perforations 1238 extending into subsurface formation 1206. The perforations 1238 are formed during completion of the well 1220 to facilitate introduction of fracturing fluid into the subsurface formation 1206 adjacent the horizontal well section 1204. During fracturing, fracturing fluid is pumped into the active well 1220 and the fluid passes through the perforations 1238 under high pressures and rate into the subsurface formation 1206. As pressure increases, the fracturing fluid injection rate increases through the perforations 1238, forming fractures that propagate through the subsurface formation 1206, thereby increasing the size and quantity of fluid paths between the subsurface formation 1206 and the uphole section 1262 of the well 120.

As fractures form and propagate from the uphole section 1262 into the subsurface formation 1206, the fractures become poroelastically coupled to the transducer fracture 1242 and corresponding pressure responses within the isolated well section 1222 are measured within the isolated well section 1222 by the pressure gauge 1244. In response to the measurements obtained by the pressure gauge 1244, the computing system 1250 may modify one or more parameters associated with the fracturing operation. For example, the computing system 1250 may be communicatively coupled to a pumping system 1232 configured to inject fracturing fluid into the well 1220 and to modify various properties of the fracturing fluid. Accordingly, the pumping system 1232 may include various pieces of equipment configured to As previously discussed in the context of two-well arrangements, such parameters may include, among other things and without limitation, a fracturing fluid injection rate, a fracturing fluid viscosity, a proppant size, an additive ratio of the fracturing fluid, and initiation of a diversion operation.

Figure 13:
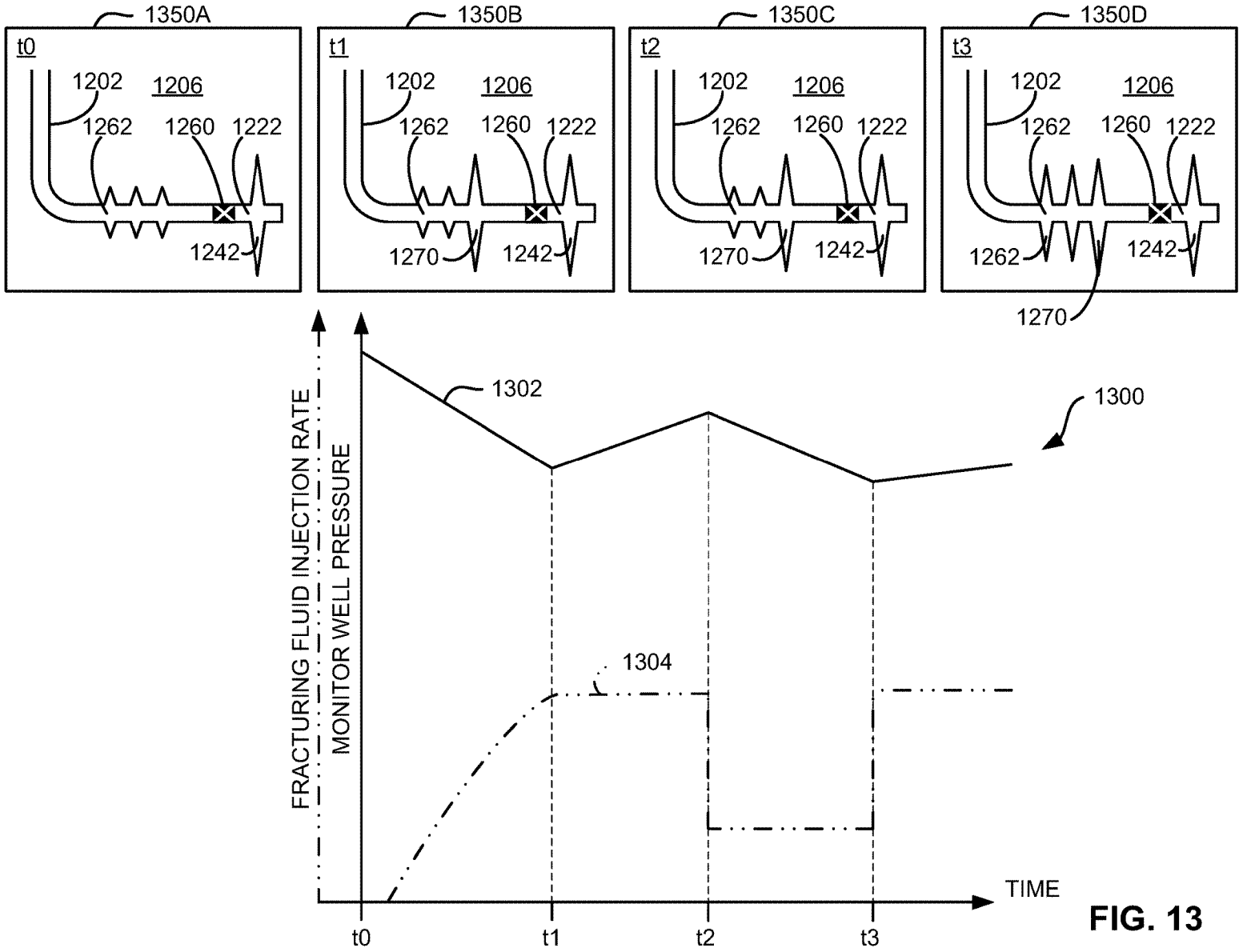
FIG. 13 is an example graph illustrating pressure within an isolated section of a well and fracturing fluid flow rate over time during a fracturing operation of the well.

FIG. 13 (with reference to elements of FIG. 12) illustrates an example implementation of a one-well implementation of the present disclosure in which pressure within the isolated well section 1222 is used to initiate a rate cycling operation. More specifically, FIG. 13 illustrates an example of how a fracturing fluid injection rate may be modified to control fracture propagation during a fracturing operation.

FIG. 13 includes a graph 1300 illustrating a fracturing operation in accordance with this disclosure. Further reference is made to schematic illustrations 1350A-D, which depict the subterranean formation 1206 at various stages of a fracturing operation conducted on the well 1220. As illustrated in illustrations 1350A-D, the well 1220 includes an uphole section 1202 and an isolation device 1260 separating the uphole section 1202 from the isolated well section 1222. The graph 1300 includes a pressure line 1302 corresponding to a pressure measurement obtained from the isolated well section 1222 (for example, by using a downhole pressure instrument, such as the pressure gauge 1244 of FIG. 12). As shown in illustrations 1350A-D, the isolated well section 1222 may include one or more transducer fractures 1242 extending into the subterranean formation 1206. The graph 1300 further includes an injection rate line 1304 shown as a dashed and dotted line.

At time t0, no fracturing fluid has been injected into the well 1220 and, as a result, no fractures have started propagating from the uphole section 1262 of the well 1202. Between time t0 and time t1, the fracturing fluid injection rate is increased, causing growth of a dominant fracture 1270 from the uphole section 1262, as indicated by the transition between illustrations 1350A and 1350B. During this time, pressure within the isolated well section 1222 exhibits a relatively steady decrease, which may be associated with leak off from the isolated well section 1222 into the surrounding formation 1206.

At time t1, the fracturing fluid injection rate is maintained at a first level. Also at time t1, initial poroelastic coupling occurs between the dominant fracture 1270 of the uphole section 1262 and the transducer fracture 1242 extending from the isolated well section 1202. As illustrated by the interval between time t1 and t2 and the corresponding upward trend in the pressure line 1302, the poroelastic coupling results in an increase rate of pressure change within the isolated well section 1222.

In response to the increased rate of pressure change within the isolated well section 1222, a rate cycle is initiated at time t2. Such rate cycling includes reducing the fracturing fluid injection rate at time t2. As a result of reducing the fracturing fluid injection rate, pressure within the isolated well section 1222 begins to decrease as indicated by a downward trend in the pressure line 1302 between t2 and t3. In other words, leak off from the isolated well section 1222 resumes in light of the reduced fracturing fluid injection rate and the corresponding reduced pressure effects applied to the transducer fracture 1242 by the dominant fracture 1270.

After a predetermined time, a predetermined reduction in pressure within the isolated well section 1222, or any other similar event, the rate cycle is completed by subsequently increasing the fracturing fluid injection rate at time t3. As shown in illustration 1350D, such rate cycling may facilitate the diversion of increased fracturing fluid into and corresponding propagation of one or more non-dominant fractures (such as non-dominant fracture 1272) extending from the uphole well section 1262. Such direction of the fracturing fluid into the non-dominant fractures may be exhibited as a decrease in the rate of pressure change within the isolated well section 1222 as compared to the rate of pressure change exhibited before rate cycling (e.g., between times t1 and t2). In other words, the rate cycling resulted in an increased proportion of the fracturing fluid being diverted into the non-dominant fractures located uphole relative to the dominant fracture 1272. As a result, the pressure effects resulting from poroelastic coupling between the dominant fracture 1272 and the transducer fracture 1242 were reduced as indicated by a reduced upward pressure trend as compared to before the rate cycling operation (i.e., between times t1 and t2).

FIG. 13 is only an example of a one-well implementation of the present disclosure. In other implementations, other fracturing operation parameters may be modified in response to pressure changes measured within the isolated well section 1222 and, more specifically, such changes resulting from poroelastic coupling of the isolated well section 1222 with one or more fractures originating from the uphole well section 1262. For example, and without limitation, one or more of a viscosity, an additive ratio, a proppant type, a proppant concentration, a proppant size, or other characteristic of the fracturing fluid may be modified in response to the pressure within the isolated well section 1222. Similarly, pressure within the isolated well section 1222 may also be used to initiated and/or otherwise control other processes during the fracturing operation. Such processes may include, for example, a diversion operation as discussed in more detail in the example fracturing operations of FIGS. 8 and 9.

Figure 14:
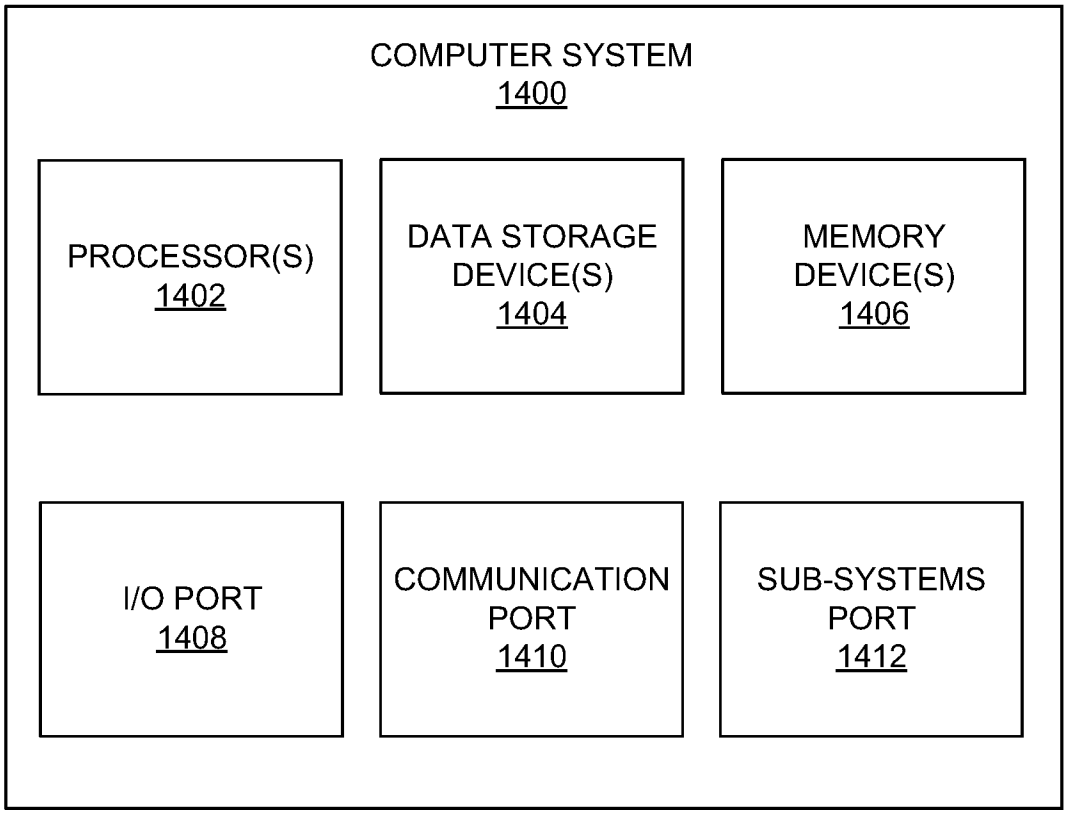
FIG. 14 is an example computing system that may implement various systems and methods of the presently disclosed technology.

Referring to FIG. 14, a detailed description of an example computing system 1400 having one or more computing units that may implement various systems and methods discussed herein is provided. It will be appreciated that specific implementations of these devices may be of differing possible specific computing architectures not all of which are specifically discussed herein but will be understood by those of ordinary skill in the art.

The computing system 1400 is generally configured to receive and process pressure measurement data from a pressure transducer or similar sensor associated with the monitor well 122 (shown in FIG. 1). Processing of pressure measurement data from the monitor well 122 may include, without limitation, performing one or more calculations on the pressure measurement data, transmitting the pressure measurement data, storing the pressure measurement data, formatting the pressure measurement data, displaying the pressure measurement data or data derived therefrom, and generating or suggesting control signals in response to the pressure measurement data. In one implementation, for example, the computing system 1400 is communicatively coupled to the pumping system 132 and is configured to generate and send control signals to the pumping system 132 to adjust the properties of the fracturing fluid provided by the pumping system 132.

The computer system 1400 may be a computing system capable of executing a computer program product to execute a computer process. Data and program files may be input to the computer system 1400, which reads the files and executes the programs therein. Some of the elements of the computer system 1400 are shown in FIG. 14, including one or more hardware processors 1402, one or more data storage devices 1404, one or more memory devices 1408, and/or one or more ports 1408-1412. Additionally, other elements that will be recognized by those skilled in the art may be included in the computing system 1400 but are not explicitly depicted in FIG. 14 or discussed further herein. Various elements of the computer system 1400 may communicate with one another by way of one or more communication buses, point-to-point communication paths, or other communication means not explicitly depicted in FIG. 14.

The processor 1402 may include, for example, one or more of a central processing unit (CPU), a graphics processing unit (GPU), an application specific integrated circuit (ASIC), a tensor processing unit (TPU), an a artificial intelligence (AI) processor, a microprocessor, a microcontroller, a digital signal processor (DSP), and/or one or more internal levels of cache. There may be one or more processors 1402, such that the processor 1402 comprises a single central-processing unit, or a plurality of processing units capable of executing instructions and performing operations in parallel with each other, commonly referred to as a parallel processing environment.

The computer system 1400 may be a conventional computer, a distributed computer, or any other type of computer, such as one or more external computers made available via a cloud computing architecture. The presently described technology is optionally implemented in software stored on the data stored device(s) 1404, stored on the memory device(s) 1406, and/or communicated via one or more of the ports 1408-1412, thereby transforming the computer system 1400 in FIG. 14 to a special purpose machine for implementing the operations described herein. Examples of the computer system 1400 include personal computers, terminals, workstations, clusters, nodes, mobile phones, tablets, laptops, personal computers, multimedia consoles, gaming consoles, set top boxes, and the like.

The one or more data storage devices 1404 may include any non-volatile data storage device capable of storing data generated or employed within the computing system 1400, such as computer executable instructions for performing a computer process, which may include instructions of both application programs and an operating system (OS) that manages the various components of the computing system 1400. The data storage devices 1404 may include, without limitation, magnetic disk drives, optical disk drives, solid state drives (SSDs), flash drives, and the like. The data storage devices 1404 may include removable data storage media, non-removable data storage media, and/or external storage devices made available via a wired or wireless network architecture with such computer program products, including one or more database management products, web server products, application server products, and/or other additional software components. Examples of removable data storage media include Compact Disc Read-Only Memory (CD-ROM), Digital Versatile Disc Read-Only Memory (DVD-ROM), magneto-optical disks, flash drives, and the like. Examples of non-removable data storage media include internal magnetic hard disks, SSDs, and the like. The one or more memory devices 1406 may include volatile memory (e.g., dynamic random access memory (DRAM), static random access memory (SRAM), etc.) and/or non-volatile memory (e.g., read-only memory (ROM), flash memory, etc.).

Computer program products containing mechanisms to effectuate the systems and methods in accordance with the presently described technology may reside in the data storage devices 1404 and/or the memory devices 1406, which may be referred to as machine-readable media. It will be appreciated that machine-readable media may include any tangible non-transitory medium that is capable of storing or encoding instructions to perform any one or more of the operations of the present disclosure for execution by a machine or that is capable of storing or encoding data structures and/or modules utilized by or associated with such instructions. Machine-readable media may include a single medium or multiple media (e.g., a centralized or distributed database, and/or associated caches and servers) that store the one or more executable instructions or data structures.

In some implementations, the computer system 1400 includes one or more ports, such as an input/output (I/O) port 1408, a communication port 1410, and a sub-systems port 1412, for communicating with other computing, network, or vehicle devices. It will be appreciated that the ports 1408-1412 may be combined or separate and that more or fewer ports may be included in the computer system 1400.

The I/O port 1408 may be connected to an I/O device, or other device, by which information is input to or output from the computing system 1400. Such I/O devices may include, without limitation, one or more input devices, output devices, and/or environment transducer devices.

In one implementation, the input devices convert a human-generated signal, such as, human voice, physical movement, physical touch or pressure, and/or the like, into electrical signals as input data into the computing system 1400 via the I/O port 1408. Similarly, the output devices may convert electrical signals received from the computing system 1400 via the I/O port 1408 into signals that may be sensed as output by a human, such as sound, light, and/or touch. The input device may be an alphanumeric input device, including alphanumeric and other keys for communicating information and/or command selections to the processor 1402 via the I/O port 1408. The input device may be another type of user input device including, but not limited to: direction and selection control devices, such as a mouse, a trackball, cursor direction keys, a joystick, and/or a wheel; one or more sensors, such as a camera, a microphone, a positional sensor, an orientation sensor, a gravitational sensor, an inertial sensor, and/or an accelerometer; and/or a touch-sensitive display screen ("touchscreen"). The output devices may include, without limitation, a display, a touchscreen, a speaker, a tactile and/or haptic output device, and/or the like. In some implementations, the input device and the output device may be the same device, for example, in the case of a touchscreen.

The environment transducer devices convert one form of energy or signal into another for input into or output from the computing system 1400 via the I/O port 1408. For example, an electrical signal generated within the computing system 1400 may be converted to another type of signal, and/or vice-versa. In one implementation, the environment transducer devices sense characteristics or aspects of an environment local to or remote from the computing system 1400, such as, light, sound, temperature, pressure, magnetic field, electric field, chemical properties, physical movement, orientation, acceleration, gravity, and/or the like. Further, the environment transducer devices may generate signals to impose some effect on the environment either local to or remote from the computing device 1400, such as, physical movement of some object (e.g., a mechanical actuator), heating or cooling of a substance, adding a chemical substance, and/or the like.

In one implementation, a communication port 1410 is connected to a network by way of which the computer system 1400 may receive network data useful in executing the methods and systems set out herein as well as transmitting information and network configuration changes determined thereby. Stated differently, the communication port 1410 connects the computer system 1400 to one or more communication interface devices configured to transmit and/or receive information between the computing system 1400 and other devices by way of one or more wired or wireless communication networks or connections. Examples of such networks or connections include, without limitation, Universal Serial Bus (USB), Ethernet, Wi-Fi, Bluetooth®, Near Field Communication (NFC), Long-Term Evolution (LTE), and so on. One or more such communication interface devices may be utilized via the communication port 1410 to communicate one or more other machines, either directly over a point-to-point communication path, over a wide area network (WAN) (e.g., the Internet), over a local area network (LAN), over a cellular (e.g., third generation (3G) or fourth generation (4G)) network, or over another communication means including any existing or future protocols including, without limitation fifth generation (5G), mesh networks and distributed networks. Further, the communication port 1410 may communicate with an antenna for electromagnetic signal transmission and/or reception.

In certain implementations, the communication port 1410 is configured to communicate with one or more process control networks and/or process control devices including one or more of standalone, distributed, or remote/server-based control systems. In such implementations, the communication port 1410 is coupled to the process control networks and/or devices by a network, bus, hard-wire, or any other suitable connection. Such process control systems may include, without limitation, supervisory control and data acquisition (SCADA) systems and distributed control systems (DCSs) and may include one or more of programmable logic controllers (PLCs), programmable automation controllers (PACs), input/output (I/O) devices, human-machine interfaces (HMIs) and HMI workstations, servers, process historians, and other process control-related devices. Accordingly, the communication port 1410 facilitates communication between the computing system 1400 and process control equipment using one or more process-control related protocols including, without limitation, fieldbus, Ethernet fieldbus, Ethernet TCP/IP, Controller Area Network, ControlNet, DeviceNet, Highway Addressable Remote Transducer (HART) protocol, and OLE for Process Control (OPC), Wellsite Information Transfer Standard Markup Language (WITSML), and Universal File and Stream Loading (UFL).

Computer system 1400 may include a sub-systems port 1412 for communicating with one or more systems related to a vehicle to control an operation of the vehicle and/or exchange information between the computer system 1400 and one or more sub-systems of the vehicle. Examples of such sub-systems of a vehicle, include, without limitation, imaging systems, radar, lidar, motor controllers and systems, battery control, fuel cell or other energy storage systems or controls in the case of such vehicles with hybrid or electric motor systems, autonomous or semi-autonomous processors and controllers, steering systems, brake systems, light systems, navigation systems, environment controls, entertainment systems, and the like. In certain implementations, the sub-systems port 1412 is configured to communicate with sub-systems of a pump truck or similar vehicle configured to provide pressurized fracturing fluid to a well including, without limitation, sub-systems directed to controlling and monitoring pumps and associated pumping equipment.

The system set forth in FIG. 14 is but one possible example of a computer system that may employ or be configured in accordance with aspects of the present disclosure. It will be appreciated that other non-transitory tangible computer-readable storage media storing computer-executable instructions for implementing the presently disclosed technology on a computing system may be utilized.

In the present disclosure, the methods disclosed may be implemented, at least in part, as sets of instructions or software readable by a device. Further, it is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A machine-readable medium includes any mechanism for storing information in a form (e.g., software, processing application) readable by a machine (e.g., a computer). The machine-readable medium may include, but is not limited to, magnetic storage medium, optical storage medium; magneto-optical storage medium, read only memory (ROM); random access memory (RAM); erasable programmable memory (e.g., EPROM and EEPROM); flash memory; or other types of medium suitable for storing electronic instructions.

While the present disclosure has been described with reference to various implementations, it will be understood that these implementations are illustrative and that the scope of the present disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow further below.

The following outlines additional claimable features:

1A. A method of obtaining a hydrocarbon comprising:

receiving a hydrocarbon produced from an active well extending through a subterranean formation, wherein the active well was previously fractured by a rate cycling process, the rate cycling process comprising:

obtaining a first rate of pressure change measurement from a monitor well extending through the subterranean formation and poroelastically couplable to the active well;

pumping a fracturing fluid into the active well at a first rate;

obtaining a second rate of pressure change measurement from the monitor well during pumping of the fracturing fluid into the active well;

identifying a difference between the first rate of pressure change measurement and the second rate of pressure change measurement; and pumping the fracturing fluid into the active well at a second rate, different from the first rate, based on the difference between the first rate of pressure change measurement and the second rate of pressure change measurement.

2A. The method of claim 1A, wherein the rate cycling process further comprises:

obtaining a third rate of pressure change measurement from the monitor well during pumping of the fracturing fluid at the second rate;

identifying a difference between at least one of the first rate of pressure change measurement and the second rate of pressure change measurement and the third rate of pressure change measurement; and pumping the fracturing fluid into the active well at a third rate, different from the second rate, based on the difference between the first rate of pressure change measurement and the third rate of pressure change measurement.

3A. A method of fracturing a subterranean formation comprising:

obtaining a first pressure measurement from a first well extending through the subterranean formation;

pumping a fracturing fluid into a second well extending through the subterranean formation, the second well poroelastically couplable with the first well, the fracturing fluid having a fracturing fluid parameter having a first parameter value;

obtaining a second pressure measurement from the first well during pumping of the fracturing fluid into the second well;

identifying a difference between the first pressure measurement and the second pressure measurement; and pumping the fracturing fluid into the second well such that the fracturing fluid parameter has a second parameter value, different from the first parameter value, based on the difference between the first pressure measurement and the second pressure measurement.

4A. The method of claim 3A, wherein the fracturing fluid parameter is one of a flow rate, a pressure, a type of fracturing fluid, a ratio of fracturing fluid components, a proppant concentration, a type of proppant, an additive concentration, a type of additive, and a density.

5A. A method of fracturing a subterranean formation comprising:

obtaining at least one first pressure measurement from a first well extending through the subterranean formation;

pumping a fracturing fluid into a second well extending through the subterranean formation;

obtaining at least one second pressure measurement from the first well during pumping of the fracturing fluid into the second well;

identifying a difference between the first pressure measurement and the second pressure measurement, the difference induced, at least in part, by a coupling of the first well and the second well; and pumping the fracturing fluid into the second well at a second rate, different from the first rate, based on the difference between the first pressure measurement and the second pressure measurement.

6A. The method of claim 5A, wherein the coupling of the first well to the second well comprises a poroelastic coupling of the first well to the second well.

7A. The method of claim 5A, wherein the coupling of the first well to the second well comprises a direct coupling of the first well to the second well such that the first well is in fluid communication with the second well.

8A. A method of fracturing a subterranean formation comprising:

obtaining at least one first pressure measurement from a first well section extending through the subterranean formation;

pumping a fracturing fluid into a second well section extending through the subterranean formation according to a first set of fracturing operation parameters, the second well section poroelastically couplable with the first well section;

obtaining at least one second pressure measurement from the first well section during pumping of the fracturing fluid into the second well section;

identifying a difference between the first pressure measurement and the second pressure measurement, the difference induced, at least in part, by a coupling of the first well and the second well; and pumping the fracturing fluid into the second well section according to a second set of fracturing operation parameters, different from the first set of fracturing operation parameters, based on the difference between the first pressure measurement and the second pressure measurement.

9A. The method of claim 8A, wherein the coupling between the first well section and the second well section includes a poroelastic coupling between the first well section and the second well section.

10A. The method of claim 8A, wherein the coupling between the first well section and the second well section includes a direct fluid coupling between the first well section and the second well section.

11A. The method of claim 8A, wherein each of the at least one first pressure measurement and the at least one second pressure measurement are obtained within a first zone of the subterranean formation and the second well section extends through a second zone of the subterranean formation offset from the first zone.

12A. The method of claim 8A, wherein each of the first set of fracturing operation parameters and the second set of fracturing operation parameters includes at least one of a fracturing fluid flow rate, a fracturing fluid viscosity, a fracturing fluid type, a proppant size, an additive concentration, and an additive type.

13A. The method of claim 8A further comprising performing a diversion operation in the second well section before pumping the fracturing fluid into the second well section according to the second set of fracturing operation parameters.

14A. The method of claim 12A, wherein the diversion operation is performed in response to identifying fluid communication between the first well section and the second well section.

15A. The method of claim 8A, wherein the first well section is a section of a first well and the second well section is a section a second well different from the first well.

16A. The method of claim 8A, wherein the first well section is an isolated section of a well and the second well section is a second section of the well uphole from the isolated section.

17A. The method of claim 16A, wherein the first well section corresponds to a toe of the well.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended thereto.

What is claimed is:

1. A method of fracturing subterranean formations comprising:

obtaining a first rate of pressure change measurement of fluid within an internal volume of a monitor well extending through a subterranean formation;

obtaining a second rate of pressure change measurement of the fluid within the internal volume of the monitor well during pumping of a fracturing fluid into a target well extending through the subterranean formation, the second rate of pressure change measurement of the internal volume of the monitor well responsive to a fracture extending into the subterranean formation from the target well; and identifying a difference between the first rate of pressure change measurement and the second rate of pressure change measurement, wherein the difference between the first rate of pressure change measurement and the second rate of pressure change measurement indicates a poroelastic response of the monitor well to the fracture without intersection of the fracture with the monitor well; and controlling a completion operation of the target well responsive to identifying the difference between the first rate of pressure change measurement and the second rate of pressure change measurement, wherein controlling the completion operation of the target well includes at least one of:

changing a flow rate of the fracturing fluid being pumped into the target well, changing a duration for which a flow rate of the fracturing fluid into the target well is maintained, changing a pressure of the fracturing fluid being pumped into the target well, changing a proppant concentration of the fracturing fluid being pumped into the target well, and changing a density of the fracturing fluid being pumped into the target well.

2. The method of claim 1 wherein controlling the completion operation of the target well includes changing the flow rate of the fracturing fluid being pumped into the target well, and changing the flow rate of the fracturing fluid includes reducing the flow rate of the fracturing fluid.

3. The method of claim 2, wherein reducing the flow rate of the fracturing fluid is to prevent intersection of the fracture and the monitor well and to relax a poroelastic region of the subterranean formation between the target well and the monitor well.

4. The method of claim 1 wherein:

the second rate of pressure change is greater than the first rate of pressure change, controlling the completion operation of the target well includes changing the flow rate of the fracturing fluid being pumped into the target well, and changing the flow rate of the fracturing fluid includes reducing the flow rate of the fracturing fluid.

5. The method of claim 4 further comprising, subsequent to reducing the flow rate of the fracturing fluid, increasing the flow rate of the fracturing fluid.

6. The method of claim 5, wherein the fracture of the target well is a dominant fracture, and wherein increasing the flow rate of the fracturing fluid subsequent to reducing the flow rate of the fracturing fluid results in an increased proportion of the fracturing fluid being diverted to a secondary fracture extending from the target well.

7. The method of claim 5, wherein the fracture extends from a first stage of the target well, and wherein increasing the pumping rate of the fracturing fluid includes directing the fracturing fluid to a second stage of the target well different than the first stage.

8. The method of claim 5 further comprising performing one or more diversion operations in the target well before increasing the pumping rate.

9. The method of claim 1, wherein the first rate of pressure change corresponds to a leak off rate of the monitor well and the second rate of pressure change corresponds to the leak off rate as modified by pressure responses induced in the monitor well due to poroelastic coupling of the monitor well and the target well.

10. The method of claim 1, wherein the monitor well includes a monitor well fracture and the target well is poroelastically couplable to the monitor well by the monitor well fracture.

11. The method of claim 1, wherein the monitor well is one of a horizontal well and a vertical well.

12. The method of claim 1, wherein:

the fracturing fluid includes a proppant, and controlling the completion operation of the target well responsive to identifying the difference between the first rate of pressure change measurement and the second rate of pressure change measurement further includes modifying at least one of a proppant type of the proppant and a proppant size of the proppant based on the difference between the first rate of pressure change measurement and the second rate of pressure change measurement.

13. The method of claim 1, wherein:

the fracturing fluid includes an additive, and controlling the completion operation of the target well responsive to identifying the difference between the first rate of pressure change measurement and the second rate of pressure change measurement further includes modifying at least one of a concentration of the additive and an additive type of the additive based on the difference between the first rate of pressure change measurement and the second rate of pressure change measurement.

14. The method of claim 1, wherein the first rate of pressure change measurement is obtained prior to pumping fracturing fluid into the target well.

15. The method of claim 1, wherein identifying the difference between the first rate of pressure change measurement and the second rate of pressure change measurement further comprises determining the difference exceeds a threshold.

16. The method of claim 1, wherein identifying the difference between the first rate of pressure change measurement and the second rate of pressure change measurement further comprises determining the difference falls below a threshold.

17. The method of claim 1, wherein each of the first rate of pressure change measurement and the second rate of pressure change measurement are obtained for a portion of the monitor well extending through a first zone of the subterranean formation and the target well extends through a second zone of the subterranean formation offset from the first zone.

18. The method of claim 1 wherein controlling the completion operation of the target well responsive to identifying the difference between the first rate of pressure change measurement and the second rate of pressure change measurement further includes modifying a viscosity of the fracturing fluid based on the difference between the first rate of pressure change measurement and the second rate of pressure change measurement.

19. A method of fracturing a subterranean formation comprising:

obtaining a rate of pressure change measurement of a fluid within an internal volume of a monitor well in a subterranean formation, the rate of pressure change measurement during pumping of a fracturing fluid into a target well extending through the subterranean formation, the rate of pressure change measurement of the internal volume of the monitor well responsive to a fracture extending into the subterranean formation from the target well; and controlling a completion operation of the target well responsive to the rate of pressure change measurement of the fluid within the internal volume of the monitor well, wherein the rate of pressure change measurement indicates a poroelastic response of the monitor well to the fracture without intersection of the fracture with the monitor well, and wherein controlling the completion operation of the target well includes at least one of:

changing a flow rate of the fracturing fluid being pumped into the target well, changing a duration for which a flow rate of the fracturing fluid into the target well is maintained, changing a pressure of the fracturing fluid being pumped into the target well, changing a proppant concentration of the fracturing fluid being pumped into the target well, and changing a density of the fracturing fluid being pumped into the target well.

20. A method of fracturing subterranean formations comprising:

obtaining a first rate of pressure change measurement of fluid within an internal volume of a monitor well extending through a subterranean formation;

obtaining a second rate of pressure change measurement of the fluid within the internal volume of the monitor well during pumping of a fracturing fluid into a target well extending through the subterranean formation, the second rate of pressure change measurement of the internal volume of the monitor well responsive to a fracture extending into the subterranean formation from the target well; and identifying a difference between the first rate of pressure change measurement and the second rate of pressure change measurement, wherein the difference between the first rate of pressure change measurement and the second rate of pressure change measurement indicates a poroelastic response of the monitor well to the fracture without intersection of the fracture with the monitor well; and controlling a completion operation of the target well responsive to identifying the difference between the first rate of pressure change measurement and the second rate of pressure change measurement, wherein controlling the completion operation of the target well includes at least one of:

modifying a proppant type in the fracturing fluid, modifying a proppant size in the fracturing fluid, modifying an additive type in the fracturing fluid, and modifying an additive concentration in the fracturing fluid, modifying a viscosity of the fracturing fluid.

* * * * *